US009903159B2

(12) United States Patent
Bettini et al.

(10) Patent No.: US 9,903,159 B2
(45) Date of Patent: Feb. 27, 2018

(54) METHOD AND SYSTEM FOR CONTROLLING THE MOVEMENT OF A MAST OF DRILLING MACHINE

(71) Applicant: SOILMEC S.p.A., Cesena (FC) (IT)

(72) Inventors: Bruno Bettini, Cesena (IT); Massimo Morellini, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 810 days.

(21) Appl. No.: 13/911,589

(22) Filed: Jun. 6, 2013

(65) Prior Publication Data

US 2014/0151078 A1 Jun. 5, 2014

(30) Foreign Application Priority Data

Jun. 8, 2012 (IT) ..... TO2012A0502

(51) Int. Cl.
*E21B 7/02* (2006.01)
*E02D 7/00* (2006.01)
*E02D 13/10* (2006.01)

(52) U.S. Cl.
CPC ..... *E21B 7/023* (2013.01); *E02D 7/00* (2013.01); *E02D 13/10* (2013.01)

(58) Field of Classification Search
CPC . E21B 7/023; E21B 7/02; E21B 7/021; E21B 19/084; E02D 7/00; E02D 7/16; E02D 13/10
USPC ..... 173/184
See application file for complete search history.

(56) References Cited

U.S. PATENT DOCUMENTS 3,071,255 A 1/1963 Bill
3,667,227 A * 6/1972 Bentkowsky ..... F15B 11/044 60/487
4,022,026 A * 5/1977 Childress ..... E21D 19/00 173/189

(Continued)

FOREIGN PATENT DOCUMENTS

EP 2067923 A1 6/2009
WO WO 2011012967 A1 * 2/2011 ..... E21B 7/023

OTHER PUBLICATIONS

European Patent Office, European Search Report, Dec. 18, 2015, 4pgs.

*Primary Examiner* — Thanh Truong
*Assistant Examiner* — Thomas Wittenschlaeger
(74) *Attorney, Agent, or Firm* — Lucas & Mercanti, LLP

(57) ABSTRACT

The method comprises the following operations: delivering a moving power to at least one linear actuator (1, 7) arranged to move a mast (5) mounted so as to swing with respect to a self-propelled structure (3) among a plurality of moving operating configurations; delivering an actuating power to a winch (8) which is supported by said self-propelled structure (3) and adapted to allow the winding or unwinding of a respective traction element which is constrained to a drilling assembly, in particular a bank of telescopic or kelly bars (12) to which a drilling tool can be associated; at least temporarily preventing a relative axial movement between said drilling assembly (12) and said mast (5) during the passage between at least two consecutive operating configurations; and automatically controlling the delivery of said moving power in a coordinated manner with the delivery of said actuating power when said axial movement is hindered.

19 Claims, 16 Drawing Sheets

(56) References Cited

U.S. PATENT DOCUMENTS

| | | | | | |
|---|---|---|---|---|---|
| 5,168,937 | A * | 12/1992 | Hamner | E21B 19/086 | 173/4 |
| 5,240,129 | A | 8/1993 | Schrick et al. | | |
| 5,269,107 | A * | 12/1993 | Klemm | E21B 3/045 | 52/115 |
| 5,927,408 | A * | 7/1999 | Dummer | E21B 19/083 | 173/1 |
| 2006/0058905 | A1* | 3/2006 | Matsuba | C03B 35/147 | 700/114 |
| 2006/0259180 | A1* | 11/2006 | Jahn | G06T 7/0046 | 700/175 |
| 2006/0278394 | A1* | 12/2006 | Stover | B60P 1/5433 | 166/308.1 |
| 2008/0044236 | A1* | 2/2008 | Lloyd | E02D 7/16 | 405/232 |
| 2008/0217037 | A1* | 9/2008 | Howell | E21B 7/022 | 173/28 |
| 2009/0039658 | A1* | 2/2009 | Spurr | E05B 77/26 | 292/336.3 |
| 2009/0139731 | A1 | 6/2009 | Rieder | | |
| 2012/0022699 | A1* | 1/2012 | Hoopmann | E05F 15/632 | 700/275 |

* cited by examiner

METHOD AND SYSTEM FOR CONTROLLING THE MOVEMENT OF A MAST OF DRILLING MACHINE

CROSS-REFERENCE TO RELATED APPLICATION

The present application claims priority of IT TO2012A 000502, filed Jun. 8, 2012, the priority of this application is hereby claimed and this application is incorporated by reference.

BACKGROUND OF THE INVENTION

The present invention refers to a method and a system for controlling the movement of a mast of a drilling machine, in particular for obtaining piles.

Foundation drillings and consolidation of the ground are generally accomplished using drilling machines of the self-propelled type, having a framework on wheels or support tracks, a rotary turret on a fifth wheel provided with a power unit (heat engine or electric motor), cabin, control accessories and typically winches for lifting the drilling accessories. The machine comprises a mast provided with sliding guides on which the rotary table (also referred to as "rotary" in the industry) linearly translates. The rotary receives power, for example hydraulic or electric, from the power unit and converts it into a rotary motion adapted to move the drilling tools. The mast is delimited at the upper part by a head comprising pulleys for returning the ropes, through which the winches arranged on the turret or also on the mast itself, lift or lower the bank of bars or the drilling tools. The latter are generally unconstrained in the axial direction, but not in the radial direction, from the rotary table which has an autonomous lifting/lowering system.

In the cases that require extremely deep drillings the technical solution typically used is that one of applying the drilling means in a bank of telescopic bars (also referred to as "Kelly bars" in the industry). Such bank of bars is generally constituted by several elements with decreasing section axially slidable one within the other and capable of transmitting rotary motion and the thrust force required for the advancement.

The banks of telescopic bars are generally divided into two types, friction bars and mechanical lock bars.

In the friction bars, the torque between the bars is usually transmitted by means of longitudinal strips welded along the elements the bar is made of, both internally and externally, so that they are engaged to each other. The transmission of axial thrust between the bars occurs by means of friction between the strips of the bars which is generated in the presence of torque. Likewise, the external element of the bank receives the rotary motion from the rotary table through the engagement between the strips of the rotary tube and the external strips of the bar, while the axial thrust transmission occurs through friction between the strips of the rotary tube and those of the external bar which is generated in the presence of applied torque. In the absence of applied torque, the bars are axially slidable with respect to each other and the entire bank is slidable with respect to the rotary table, moved by a suitable flexible means, preferably through a cable.

In the case of the mechanical lock bars, on the external bar, at the top, at the base and sometimes also at the intermediate position there are generally obtained some seats where there are engaged the strips of the rotary tube remaining axially locked. This allows transmitting both the torque and the thrust through an abutment with a mechanical stop on the strips and not only by friction. When the strips of the tube are engaged in the seats of the external bar, it is axially constrained to the rotary. Rotating in the opposite direction of the rotary allows disengaging the strips of the tube from the seats of the bar thus making the bar slidable with respect to the rotary. The same system is used for the transmission of torque and thrust between the bars: at the bottom of each bar there is obtained a tube with strips facing inwards, which end up engaged in the seats of the innermost bar.

During the drilling, all the internal elements initially slip from the telescopic bar and progressively with the depth of the drilled hole, the internal elements continue the descent. When the most external one of the internal elements reaches its lowest position it settles in mechanical abutment on the most external element which is on the rotary. The remainder of the internal elements then further continue the descent until the next most external one of the internal elements reaches the lowest position and settles into mechanical abutment with the previous most external one of the internal elements. This continues until the last of the internal elements is in its lowest position.

At the end of the drilling step, extracting the tool from the ground requires returning the bank of bars to the minimum length retracted configuration. This occurs by actuating the winch, generally referred to as main winch, usually mounted on the base machine (on the turret) whose rope—after being returned to the head of the mast—ends up connected to the upper end of the innermost element of the telescopic elements that the kelly bar is made of. The winding of the rope on the drum causes the re-ascent of the most internal bar which at the end of the travel thereof progressively draws the intermediate bars and then the more external ones progressively.

Frequently, on the base machine (turret) and sometimes also alternatively on the mast, there is installed a second winch, called auxiliary or secondary winch, whose rope is returned on the head and has—at the free end—a hook or grip members which allow lifting the loads, armatures or required equipment which should be moved during the operating steps of execution of work. In this type of machine, the sliding of the bank of bars is made autonomous with respect to the sliding of the rotary table on the guides of the mast. In addition a dedicated system, such as a hydraulic cylinder (for example, a preferably long stroke cylinder or a multi-acting hydraulic cylinder) or a third winch (referred to as "pull-down" winch in the industry) is installed to allow the sliding of the rotary table over the entire length of the mast itself (in the case of the winch) or in the first lower half thereof (in the case of the cylinder). Usually, the third winch, when present, is mounted almost exclusively on the mast and not already on the turret of the machine and it is returned on the ends of the mast to exert pulling and thrust forces on the rotary.

In order to reduce the front and lateral oscillations and diversions of the bank of telescopic bars with respect to the mast during the drilling, there may be present a bar guide head slidable on the mast and connected to the upper end of the external bar. Such connection allows the rotation of the bank but prevents the relative axial sliding between the bank and bar guide head which is thus drawn by the bank bars when the latter slides with respect to the mast. It performs a function of limiting the radial oscillations of the end of the kelly bar, especially when executing inclined or not perfectly vertical drilling.

In order to prepare the machine for transportation on the road network outside the worksite it is necessary to recline the mast up to bringing it to the lying or horizontal position so that the total height of the machine in transportation configuration is the lowest possible and allows meeting the height limits requirements set by the road requirements. The mast may be laid at the rear part on the turret or at the front part, cantilevered on the font part, at the front of the cabin. Any components exceeding the allowed maximum height must be disassembled for transportation and thus reassembled upon reaching the worksite.

TECHNOLOGICAL BACKGROUND

With reference to drilling machines dimensioned up to a weight of fifty tons there is generally known the technical solution of providing a proper compartment which extends longitudinally in the base machine body (turret) capable of at least partly housing—height-wise—the body of the mast at a lower height with respect to the upper surface of the side casings. This solution allows meeting the road transportation height requirements without having to disassemble the rotary table and the telescopic bar (Kelly bar) from the mast. The aforementioned solution allows considerably saving the time required for assembly.

Additionally to the solution described above, in the industry there are known solutions like the ones represented in FIGS. 1 to 7. Such solutions imply further saving the assembly time, this being obtained leaving the paths travelled by the ropes from the winches to the return pulleys up to reaching the various uses even when the machine is in transportation configuration unaltered. However, in the latter case, considering saving the assembly time, the presence of the ropes complicates the steps of lifting and lowering the mast when required to pass from the transportation configuration to the operating configuration and vice versa thus requiring a particular attention by the operator during the manoeuvres. The simpler machines are provided with a mast lifting system which, through at least one hydraulic cylinder, arranges the mast from a horizontal transportation configuration to an angled, vertical or even beyond vertical one, this being an operating configuration (FIG. 7), through a simple rotation of the mast with respect to a connection fulcrum between the mast and the base machine body. In these machines, the variation of the operating radius, when present, is assigned to a slide which moves—by a few tenths of centimeters—the entire mast support framework, with respect to the turret (see the height Q represented in FIG. 7). The more complex machines, have an additional device manoeuvred by at least one additional hydraulic cylinder, which—actuating a parallelogram system—allows, regardless of the inclination assumed by the mast, varying the position of the operating axis with respect to the centre of the rotation fifth wheel. Alternatively, the second actuator may move a kinematic element at direct contact with the mast of the non-parallelogram type and which however—due to the simplicity and versatility thereof—allows varying the operating radius thus requiring an adjustment of the inclination of the mast or antenna.

With reference to FIGS. 2 to 6, now there shall be described a lifting manoeuvre, carried out with the drilling machine of the aforementioned type.

In particular, with reference to FIG. 1, there is illustrated a type of known drilling machine, in which the movement of the parallelogram for adjusting the drilling height with respect to the fifth wheel centre is entrusted to at least one jack 1 for moving the arm 4, associated to a triangular support 2 connected to a turret 3 through the arm 4 and at least one connecting rod 4*a* whose length is equivalent to that of the arm 4. In a very common variant, the jack 1 for moving the arm, instead of being directly associated to the triangular support 2 is associated to the arm 4. The actuation of the jack 1 (represented as a solid line herein) allows translating a mast 5 from a minimum operating radius position, observable in FIG. 5, up to a maximum operating radius position, observable in FIG. 4, maintaining the inclination constant. At least one jack 7 for moving the mast (represented herein as a line) which connects the mast 5 to the triangular support 2 ensures the lifting of the mast and adjusts the inclination thereof with respect to the ground level. This movement is made possible by means of an articulated joint 6, such as a cardan joint, which allows the movement of lifting and lowering the mast 5 from a horizontal position to a substantially vertical position, as well as limited lateral inclination movements, or swinging, of the mast 5 with respect to the triangular support 2.

On the mast 5 there is arranged a rotary table or rotary 10 provided with a push-pull system 11 of the per se known type. Through the rotary table 10 a drilling assembly is arranged, such as a bank of telescopic or kelly bars 12. The bank of telescopic bars 12 is guided at the lower part, by the sleeve of the rotary table 10 and at the upper part by a bar guide head 13. In the machines provided with the parallelogram kinematism, when passing from the transportation condition with the mast 5 arranged horizontally (as observable in FIG. 2) to the operating condition with the mast arranged vertically (as observable in FIGS. 5 and 6), a kinematism lifting manoeuvre must be performed before swinging the mast 5.

In particular with reference to FIG. 3, the aforementioned lifting manoeuvre is obtained by initially actuating the jack 1 for moving the arm 4 so as to bring the mast 5 to the horizontal position above the casings (intermediate or lifted configuration) and entirely outside a longitudinal compartment obtained in the base machine or turret 3.

The manoeuvre of lifting the mast 5 shall be executed only at a subsequent step by actuating the lifting jack 7 so as to vary the inclination thereof up to attaining a substantially vertical straight or operating configuration. Actually, after lifting the entire mast 5 with the first movement, it is possible to rotate the lifting of the mast 5 from the intermediate configuration to the straight configuration, solely by acting on the movement jack 7 of the mast 5. Thus, during the actuation of the jack 7 the lower part of the mast 5 does not risk impacting against the ground, because it was lifted previously.

However, the aforementioned type of drilling machines reveal some drawbacks.

First and foremost, the manoeuvres of lifting the mast 5 described above cause—both in the machines provided with and those without the parallelogram kinematism—the moving away of the mast 5, and thus also the head and the bank of bars 12, from the base machine 3 on which the winches 8, 9 are mounted. During the manoeuvre, should the ropes be mounted and the length of the unwound ropes remain constant, they are tensioned and the rope of the main winch 8 shall exert a pull action on the bank of bars 12 to which the rope is connected. Without the operator unwinding the rope of the main winch 8, this manoeuvre generates an ascent of the load (i.e. of the bank of bars 12) through the rotary table 10, towards the head of the mast 5, up to coming to contact therewith, leading to disastrous consequences for the equipment and the safety of the workers. In case of presence of mechanical end stroke elements, the progressive tensioning of the rope would lead to hazardous breakage given the unpredictability in terms of stresses during the design step.

In the light of the above, in order to provide the operator a reasonable safety margin during this delicate manoeuvre, there is commonly left a manoeuvre space, indicated with K in FIG. 1, present between the upper end part of the bank of bars 12 and the head so as to allow at least one brief sliding without impacts before being forced to unwind the rope. Said space K, in some cases may be a few tenths or hundredths centimeters long.

With reference to the manoeuvre between the lowered or transportation configuration of FIG. 2 and the lifted or intermediate configuration of FIG. 3, it may be actually observed that the position of the rotary table 10 is always at the same height R along the mast 5. On the contrary, the manoeuvre or slack space of the drilling assembly or bank of bars 12 tends to drop from the value K1 to the value K2 due to the sliding of the bank of bars 12 with respect to the mast 5, whose projection beyond the rotary table 10 drops from the value D1 to the value D2.

In the light of the above, the need for this manoeuvre or slack space K, however forces limiting the length L of the bank of telescopic bars 12 and hence reducing the maximum theoretic drilling depth by an amount proportional to the length of the manoeuvre space (such amount can be defined as the difference between K1 and K2) multiplied by the number of telescopic extensions the bank of bars 12 is made of.

Clearly, the same tensioning effect of the rope during the lifting of the mast 5 also applies to the rope of the auxiliary winch 9 (also referred to as secondary winch 9), which is commonly statically constrained to a loop arranged at the base of the mast 5 so as to prevent it from hazardously oscillating freely during the assembly manoeuvres. Therefore, in this case the problem of maintaining a suitable manoeuvre space for the rope of the auxiliary winch is even more limiting. Actually in this case no relative sliding analogous to the one provided for between the bank of bars 12 and the head is allowed. Thus, the rope of the auxiliary winch 9 offers fewer alternatives and it should be kept unwound during the entire step of ascent manoeuvre.

The operator in the cabin is thus forced to perform the lifting of the mast 5 from the transportation to the operating configuration performing progressive steps, each of which requires the execution of a plurality of manoeuvres controlled by a plurality of independent manipulators 20, 21, 22, 23 and thus which can be summarised with reference to FIG. 1 and the scheme shown in FIG. 8:

a) partially lifting of the kinematism (if present) through the control of the manipulator 20 preferably of hydraulic type which actuates the jack 1 for moving the arm 4 or partial lifting of the mast 5 through the control of the manipulator 23 preferably of electrical type which actuates the jack 7 for moving the mast 5;

b) partially unwinding the rope of the main winch 8 through the control of the manipulator 21 preferably of the hydraulic type; and c) partially unwinding the rope of the auxiliary winch 9 through the control of the manipulator 22 preferably of the hydraulic type.

FIG. 1 shows a moment of the lifting or ascent step wherein the operator has just unwound the auxiliary winch 9 due to the fact that it is too tensioned and the rope of the main winch 8 is tensioned as it is subjected to the weight of the kelly bar 12 which tends to be arranged in the lowest possible configuration along the mast 5.

Secondly, the presence of the ropes of the winches 8, 9—if the path thereof is left unaltered during the manoeuvres—hinders and also slows the steps of lowering the mast 5 when required to pass from the operating to the transportation configuration.

In particular the manoeuvres for lowering the mast 5 causes, in the drilling machines provided with and without parallelogram kinematism, an approach of the mast 5, and thus also the head and the bank of bars 12, at the base machine or turret 3 on which the winches 8, 9 are mounted. During the manoeuvres should the ropes be mounted and the length of the unwound ropes remain constant, there would occur an axial sliding downwards the bank of telescopic bars 12 through the rotary table 10. Thus, the bank of bars 12 would risk impacting the ground, whereas the rope of the auxiliary winch 9 would loosen thus risking disengaging from the pulleys or reaching hazardous movement points.

The operator in the cabin is thus forced to lower the mast 5 from the working to the transportation configuration executing new progressive steps, each of which requires the execution of a plurality of manoeuvres controlled by a plurality of independent manipulators 20, 21, 22, 23:

a) partially lowering the kinematism (if present) by controlling the hydraulic manipulator 20 which actuates the jack 1 for moving the arm 4 or partially lowering the mast 5 by controlling the electric manipulator 23 which actuates the jack 7 for moving the mast 5;

b) partially winding the rope of the main winch 8 by controlling the hydraulic manipulator 21; and c) partially winding the rope of the auxiliary winch 9 by controlling the hydraulic manipulator 22.

Thirdly, should the path of the ropes of the winches 8, 9 be left unaltered during the aforementioned manoeuvres, they also hinder and slow the swinging steps of the mast 5 when required to pass from the operating to the transportation configuration. For the sake of clarity, the term swinging is used to indicate a rotation of the mast 5 around a horizontal axis substantially perpendicular to the oscillation axis (i.e. relative to a rotation) of the mast with which the mast 5 is arranged laterally inclined with respect to the longitudinal plane of the machine. Such swinging operation may occur under any operating condition (antenna substantially vertical or horizontal). The lateral swinging of the mast 5 from the central position rightwards or leftwards causes the moving away of the upper part of the mast 5 and the head from the turret. This situation causes the tensioning of the ropes leading to problems entirely analogous to the ones described in the case of lifting the mast 5. Likewise the operator shall once again be forced to perform the swinging and the unwinding of the ropes of the main winch 8 and the secondary winch 9 with progressive steps, each of which requires the execution of various manoeuvres controlled by a plurality of independent manipulators.

Thus, during the lifting, lowering and swinging of the mast 5, the need of actuating a plurality of manipulators makes it impossible for the operator to carry out the simultaneous and synchronised performance of the various manoeuvres. Furthermore, this restriction requires the continuous suspension of the manoeuvre and extreme care not to create problems in the movements caused on the bank of bars 12 or on the spare rope.

A known example of a method and machine for controlling the movement of a mast of a mobile crane is described in document U.S. Pat. No. 5,240,129.

This document illustrates a device for controlling the inclination of the mast of a crane by using a winch and a hydraulic cylinder provided with counter-balancing controls. In particular, reference is made to a crane in which the mast—in non-operating conditions (transportation)—is wheeled in the direction opposite to the operating direction with respect to the vertical. During the step of lifting the mast from the operating to non-operating position, the mast is lifted by actuating the winch and causing the compression of the hydraulic cylinder. In addition, the counter-balancing valve which limits and controls the outflow of oil from the cylinder through a constriction so as to counter a resistance to the movement of the mast such to keep the ropes tensioned, is activated. Continuing the manoeuvre towards the transportation configuration, once the mast exceeds the vertical, it would tend to descend spontaneously towards the non-operating position due to gravity loosening the ropes while the cylinder would continue acting as a counter-balancing element. In this step the operator should however continue actuating the winch to collect the ropes until the mast attains a position close to the non-operating one. Thus there is no automatic winding of the rope and—during the winding—the tension present on the rope depends on the actuation of the operator, thus if the winding speed is excessive with respect to the cylinder closing speed allowed by the constriction this will lead to an increase of pressure in the cylinder.

When the mast is reclined to take the transportation configuration the control device allows deactivating the winch slightly before the end position is attained (at about 170°), to prevent the rope winch from being inadvertently actuated and damaging the system.

During the step of lifting the mast from the non-operating position to the operating position the mast is lifted by actuating the hydraulic cylinder while the counter-balancing valve passes to the direct operating mode (without constrictions). In this step the operator should unwind the rope of the winch to allow the lifting movement. Upon exceeding the configuration with the vertical mast, the mast would tend to spontaneously descend towards the operating configuration. The mast continues to be moved by extending the cylinder while the rope is unwound by the operator by actuating the winch for controlling and limiting the movement. Also this step of actuating the winch is not automatic and the tensioning value on the rope is not predetermined.

Once the mast reaches the operating position, the micro-switch for actuating the inter-lock is actuated to bring the hydraulic cylinder to the free sliding condition. In this condition, the flow of oil from and to the cylinder is free, hence the cylinder is in non-operative condition (it does not generate positive forces or negative resistances to the movement). Thus, the cylinder has the function of damping the movements without reducing the lifting capacity.

However, the aforementioned technical solution disclosed by document U.S. Pat. No. 5,240,129 substantially reveals the same drawbacks described above regarding the contents of FIGS. 1-8.

SUMMARY OF THE INVENTION

An object of the present invention is to provide a method and a system capable of overcoming these and other drawbacks of the prior art, and which can be simultaneously obtained in a simple and inexpensive manner.

In particular, an object of the present invention is to relieve the operator from the complex and hazardous manoeuvres described above with reference to the prior art, thus reducing the controls required to be performed manually during the steps of lifting and lowering the mast.

According to an advantageous aspect of the present invention, the manoeuvre of the operator shall be simply limited to manipulating the dedicated controls (switches, manipulators, buttons or the like), through which all the operations described above in detail are carried out in a continuous, synchronised, safe and automatic manner, thus obtaining a simplification of the drilling machine in use.

According to the present invention, these and other objects are attained through a method and a system obtained according to the attached claims.

It shall be understood that the attached claims constitute an integral part of the technical teachings provided in the detailed description outlined hereinafter regarding the present invention.

BRIEF DESCRIPTION OF THE DRAWINGS

Further characteristics and advantages of the present invention shall be clearer from the detailed description that follows, provided purely by way of non-limiting example, with reference to the attached drawings, wherein.

DETAILED DESCRIPTION OF THE INVENTION

The same alphanumeric reference numbers are associated to details and elements similar—or having analogous functions—to those of the drilling machines illustrated above. For the sake of brevity, a description of such details and elements shall be outlined summarily and shall not be repeated in detail hereinafter, given that for in-depth aspects regarding such details and elements, reference shall be possibly made to the description outlined above regarding FIGS. 1 to 8.

Figure 9:
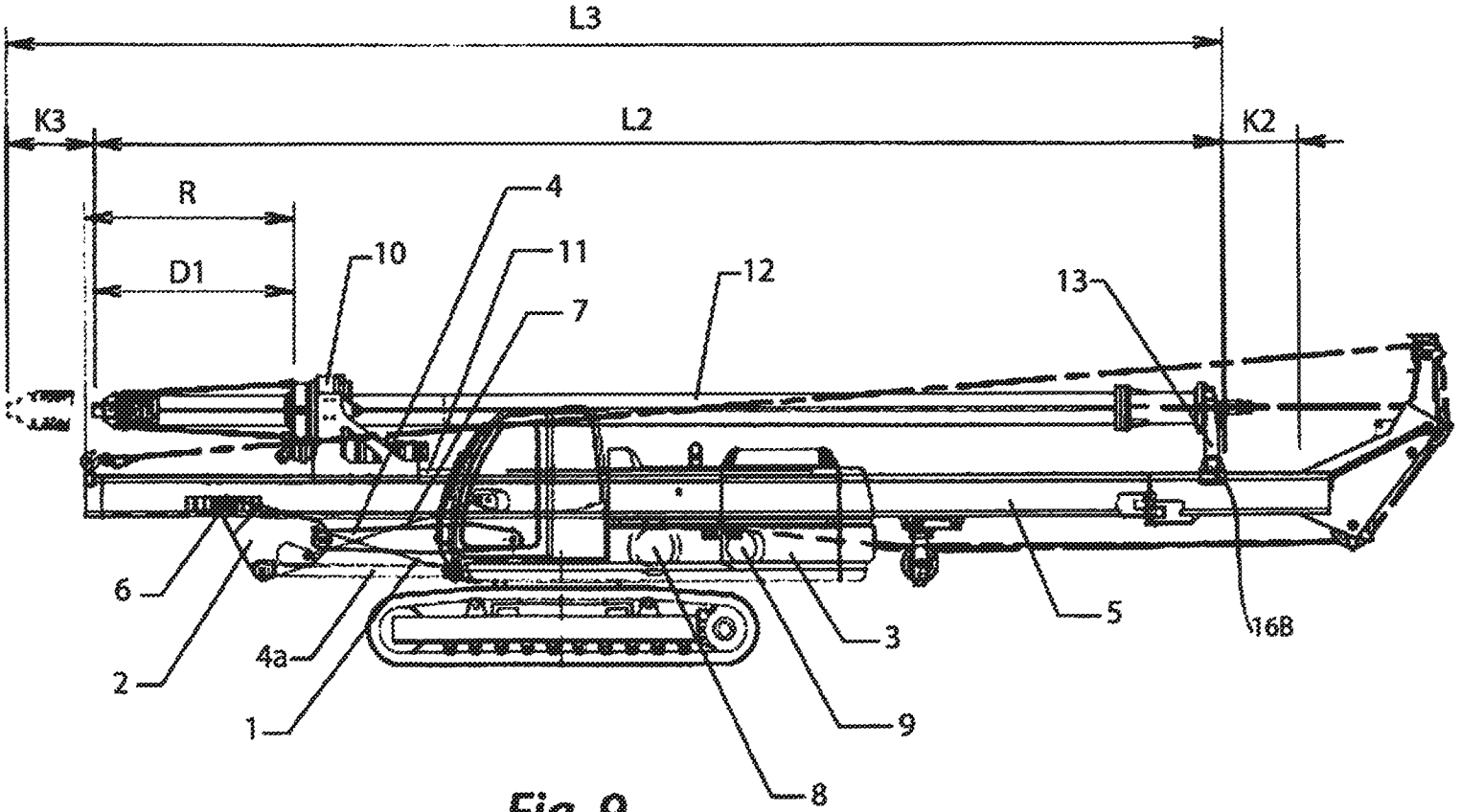
FIGS. 9 and 10 are side elevation views analogous to those of FIGS. 2 and 3, but showing a further drilling machine which is represented in a transportation or lowered configuration and in an intermediate or lifted configuration, and which implements an embodiment of a control method and system according to the present invention.
Figure 10:
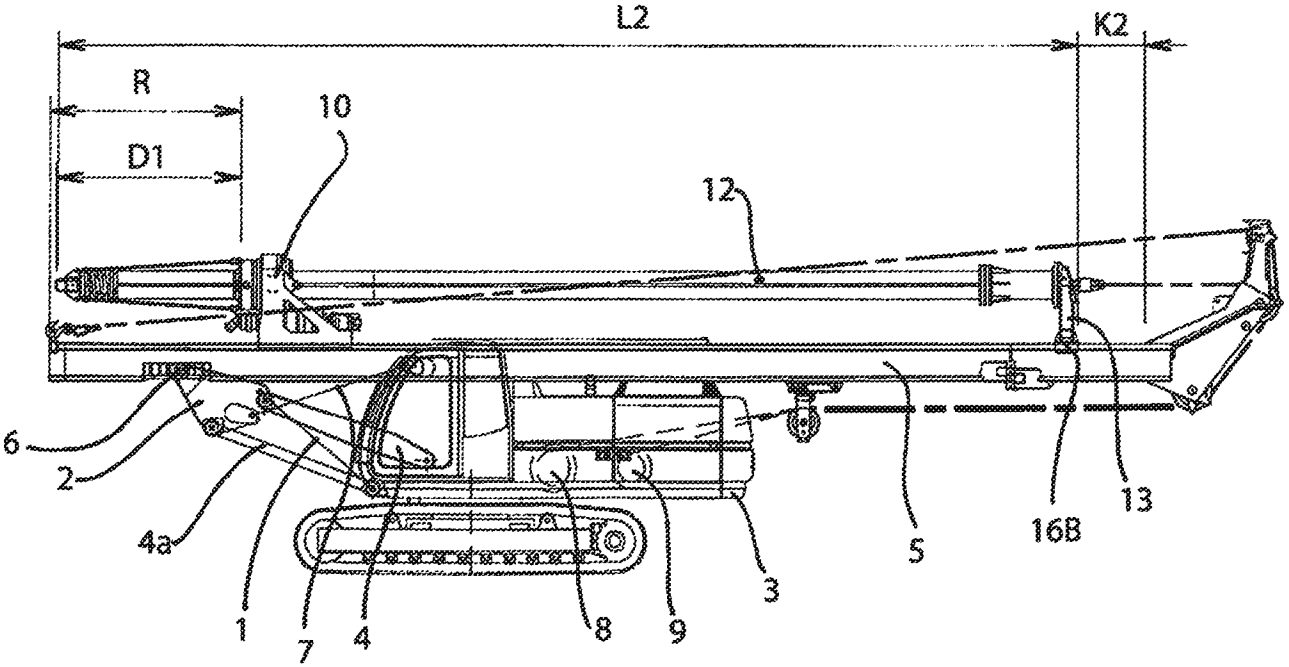

FIGS. 9 and 10 illustrate a drilling machine using an exemplifying embodiment of a method and a system according to the present invention.

The machine comprises a self-propelled structure 3 and a mast 5 mounted so as to swing with respect to the self-propelled structure 3 among a plurality of operating configurations. In addition, the machine comprises a winch 8, also referred to in the present description as main winch, which is supported by the self-propelled structure 3 and configured to allow the winding or the unwinding of an associated traction element (for example, a rope) which is fixed to the winch 8 and which is constrained to a drilling assembly 12 (for example, a battery of telescopic or kelly bars) mounted moveable axially guided along the mast 5.

FIGS. 9 and 10 illustrate the passage from a transportation operating configuration in which it is lowered to a raised operating configuration of the mast 5 which remains in substantially laid or horizontal position (observable in FIG. 10).

As described more in detail hereinafter, the method comprises the operations of:

delivering a moving power to at least one linear actuator 1, 7, preferably a jack or fluid control cylinder (pneumatic or hydraulic), arranged to move a mast 5 mounted so as to swing with respect to a self-propelled structure 3 among a plurality of operating configurations; and delivering an actuating power to a winch 8, preferably a fluid control (hydraulic or pneumatic), which is supported by said self-propelled structure 3 and arranged to allow the winding or unwinding of a respective traction element which is constrained to a drilling assembly, in particular a bank of telescopic or kelly bars 12 to which a drilling tool can be associated;

at least temporarily preventing and at least in a sense along the longitudinal axis of the mast 5 a relative axial movement between said drilling assembly 12 and said mast 5 during the passage between at least two consecutive operating configurations; and automatically controlling the delivery of said moving power in a coordinated manner with the delivery of said actuating power when said axial movement is hindered.

The term "moving power" means the energy (in any form) for moving the drilling mast 5 between any of the operating positions thereof, such as the laid rear horizontal operating position, the laid lifted and horizontal operating position, the vertical operating position, the inclined operating position, the lateral swinging operating position, the front part laid operating position and any intermediate position therebetween. In particular the use of a moving power is required both in the lifting or ascent step as well as in the lowering or descent of the mast 5.

Winch actuation power stands for any form of energy used over the time unit for supplying the control of the winch so as to allow, for example, the deactivation of the brake or also the rotation of the drum thereof in one of the two directions. The winch actuation power is thus used both in case of winding the rope on the winch and in case of the unwinding the rope therefrom.

Analogously to the method and as described in detail hereinafter, the system comprises:

a movement supply circuit configured so as to be connected with a power source and for delivering to at least one linear actuator 1, 7, preferably a jack or fluid control cylinder (pneumatic or hydraulic), a moving power so as to move a mast 5 mounted so as to swing with respect to a self-propelled structure 3 among a plurality of moving operating configurations;

an actuating supply circuit configured so as to be connected with a power source and for delivering an actuating power to a winch 8, preferably a fluid control (pneumatic or hydraulic), which is supported by said self-propelled structure 3 so as to allow the winding or unwinding of a traction element which is constrained to a drilling assembly, in particular a bank of telescopic or kelly bars 12 to which a drilling tool can be associated;

locking means 14, 15, 16, **16*b*, 17, which can be deactivated, arranged to at least temporarily prevent, and at least in a sense along the longitudinal axis of the mast 5, a relative axial movement between said drilling assembly 12 and said mast 5 during the passage between at least two consecutive operating configurations; and control means configured for automatically controlling the delivery of said moving power in a coordinated manner with the delivery of said actuating power when said locking means prevent said relative axial movement at least in a sense along the longitudinal axis of the mast 5**.

With reference to the illustrated embodiment, the movement supply circuit may comprise, for example, the controls, the lines involved by the operation of the actuators (which shall be described in detail in a non-limiting manner hereinafter), the selection and control valve groups, and the actuators themselves which can be identified as linear actuators, preferably of the fluid control cylinders.

With reference to the illustrated embodiment, the actuating supply circuit may comprise, for example, the controls, the lines involved by the operation of the actuators (which will be described in detail in a non-limiting manner hereinafter), the selection and control valve groups, and the actuators themselves which can be identified as winches.

With reference to the illustrated embodiment, the control means may comprise, for example, the set of control valves, solenoid valves or similar elements which direct the flow of pressurised fluid in a coordinated manner for the delivery of the actuating power on the winches.

Still with reference to the illustrated embodiment, the control means may further comprise the pressure sensors which have the function of guiding and providing consent to the lifting or lowering of the mast. Furthermore, the control means may comprise detection means 18, 130 of the end stroke position of the bar guide head 13 when the axial movement of said drilling assembly 12 is allowed towards the upper part of said mast 5. Such detection means 18, 130 of the end stroke position of the bar guide head 13, observable in FIG. 16, may comprise a sensor 18 such as for example an electric switch 18 or alternatively a hydraulic tracer (not illustrated) or a proximity sensor (not illustrated) and an abutment detector 130, for example a cam, arranged on the bar guide head and arranged to activate such sensor 18 for guiding and providing consent to the delivery of actuating power.

The aforementioned characteristics allow reducing the effort of the operator during the movement of the mast 5, in particular during at least one movement—in elevation or ascent or with the aim of lowering or descent:

between the lowered or transportation configuration and the lifted or intermediate configuration, shown in FIGS. 9 and 10, in which the mast 5 remains in laid or substantially horizontal position;

between the lifted or intermediate configuration and the straight or operating configuration (not illustrated but analogous to FIG. 4 or 5 of the prior art), wherein the mast 5 is rotated with a swinging movement around an oscillation axis (it should be observed that the straight configuration may correspond to an arrangement close to vertical but it may also be inclined at the front or rear part); and between the straight or operating configuration and an inclined configuration laterally or swinging (not illustrated), wherein the mast 5 is rotated in swinging manner around a swinging axis perpendicular to the oscillation axis.

Actually, in this case the operator is no longer required to manually coordinate the management of the mast 5 and the winch 8 during the aforementioned manoeuvres, given that the automatic control shall govern the mast 5 in a coordinated manner with the winch 8 so as to prevent the traction element from loosening or contracting excessively, risking causing malfunctioning or damage to the drilling machine.

Furthermore, these characteristics allow the installation of a drilling set 12 having a length L2 greater than the length L regarding the example of the prior art described previously with reference to FIGS. 1 to 8. Clearly, this is particularly advantageous where the drilling set is a bank of bars 12 representing a preferred application example of the present invention. Actually, the benefit of increasing the length from value L to value L2 is "multiplied" by each bar which forms the aforementioned bank of telescopic or kelly bars 12, with the ensuing considerable advantage in terms of performance.

In the illustrated embodiment, as observable in particular from the passage from FIGS. 9 to 10, the method provides for at least temporarily preventing, at least in a sense along the longitudinal axis of the mast 5, a relative axial movement between the mast 5 and the drilling assembly 12 during the movement of the mast 5 between the various operating configurations. Thus, the control system may be advantageously associated with a first locking device which is represented, in an enlarged manner in FIG. 11 or the combination of a second locking device, which is represented in an enlarged manner in FIG. 15, and means for detecting the end stroke position of the bar guide head which are represented in FIG. 16. More in detail, the drilling assembly, for example provided by the bank of telescopic or kelly bars 12, is prevented from moving at least towards the lower part of the mast 5, preventing the relative axial sliding.

Figure 11:
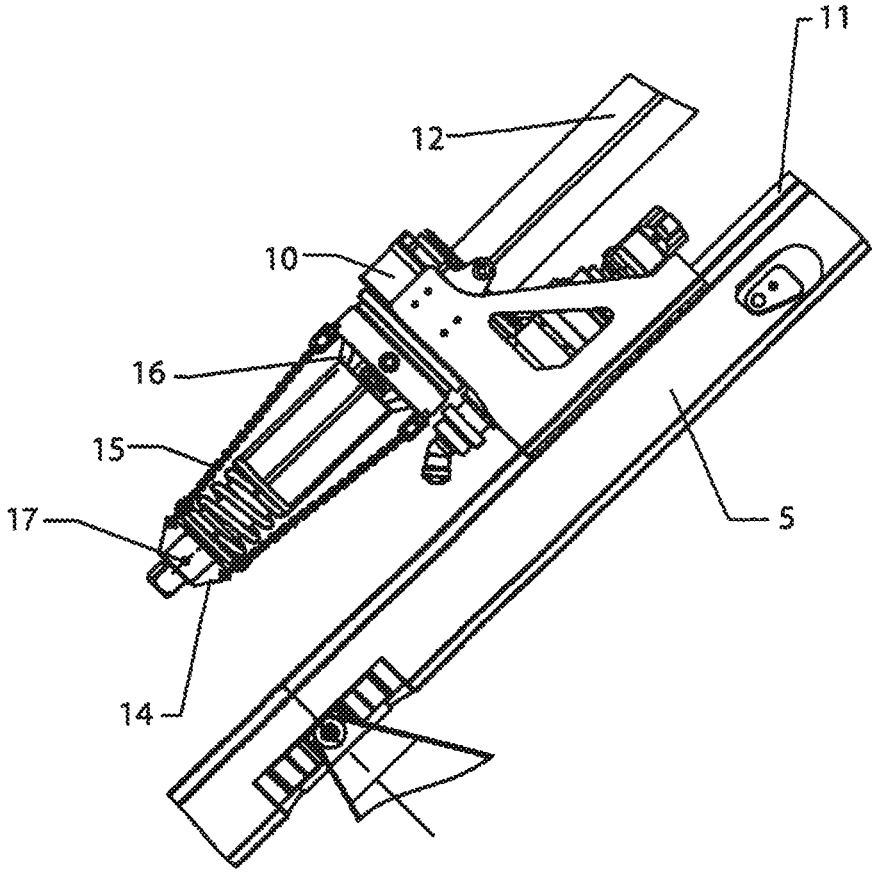
FIG. 11 is a detailed view of a locking device employed in a first embodiment of a control method and system according to the present invention.

This result is obtained by a first embodiment with a connection of the indirect type for connecting the bank of telescopic bars 12 to the rotary table 10, according to the structure shown in detail in FIG. 11.

The locking device comprises a collar 14 which is coupled to the lower terminal part of the most internal bar of the bank of telescopic bars 12, where a tool drive square or a coupling means (for transferring the torque and the thrust forces required for the drilling to the tool) is present. The transverse dimension of the collar 14 is sufficient to host the tool drive square, and it is simultaneously lower than that of the inner bar. Thus, the sliding of the collar 14 towards the upper end of the bank of bars 12 shall be hindered. In addition the collar 14 may be fastened to the lower end part of the most internal bar through a transverse pin 17 so as to prevent the decoupling in any manner.

In the illustrated embodiment, the collar 14 has at least one fixing point for a bridle or retention element 15 which in turn shall be connected to the rotary table 10 at proper fixing points present thereon. For example, the fixing points may be directly positioned on the rotary casing or indirectly on one of the accessories connected thereto such as for example the aforementioned bucket-stroke flange, or the so-called driving flange casing, and so on. Preferably the collar 14 and the rotary table 10 are connected by a plurality of bridles or retaining elements 15. Upon the execution of the connection between the collar 14 and the rotary table 10 through the retaining element 15, each axial sliding of the bank bars 12 with respect to the rotary table 10 towards the base of the mast 5 is hindered by the resistance opposed by the retaining element 15, which is tensioned or stressed in traction. Hence each axial sliding of the bank of bars 12 with respect to the mast 5 in the direction of the base of the latter is hindered, given that also the rotary table 10 is held in fixed position with respect to the mast 5 through a push-pull system 11 of the per se known type in the industry (for example, of the cylinder type, of the winch with rope type, of the geared motor with chain type, or other equivalent systems). The retaining element 15 may be of the flexible (for example, a cable or a chain) or rigid (for example, a bar or a length-wise adjustable bar) type.

In a first variant with respect to the embodiment shown in FIG. 11, the collar 14 may be directly constrained to the mast 5.

In a second variant with respect to the embodiment shown in FIG. 11, the lower end of the most internal bar of the bank of bars 12 may be directly constrained to the mast 5 through a pin or any other rigid element.

Still according to the embodiment shown in FIG. 11, the locking device also comprises a retention clamp 16 coupled, for example, by friction to the external bar of the bank of telescopic bars 12, preferably in the bar section which is extended immediately below the rotary table 10. By way of example, the clamp 16 comprises a pair of jaws, preferably obtained as two semicircular parts which can be approached in a ring-like manner, hinged to each other at a connection end so that the clamp 16 is capable of opening to embrace the external bar of the bank of bars 12. At the other connection end the two jaws are preferably connected through a tensioning bar which allows, when the external bar is embraced, fastening the clamp so as to make it integral to the bar by friction. Thus, the axial translation of the bank of telescopic bars 12 with respect to the rotary table 10 towards the upper part of the mast 5 is stopped by an axial abutment which occurs between the clamp 16 and the rotary table 10. Also the rotary table 10 is held in fixed position with respect to the mast 5 by the previously mentioned push-pull system 11, thus any axial sliding of the bank bars 12 with respect to the mast 5 in the direction of the top part of the latter is hindered.

The use of the retention clamp 16 is particularly convenient in case of use of a bank of telescopic bars 12 of the friction type. Actually, regardless of the relative axial position between the bank bars 12 and rotary table 10 the strips of the tube of the rotary table 10 are not capable of safely locking the sliding of the bank of bars 12.

On the contrary, in case of use of a bank of telescopic bars 12 of the mechanical locking type, the use of the retention clamp 16 is always convenient but less preferred with respect to the previous case. In particular this is evident in case it is intended to engage the strips of the tube of the rotary table 10 in the seats of the external bar for locking the axial sliding of the bank of bars 12 with respect to the rotary table 10 during the movement of the mast 5 and the arm 4 for passing from the transportation configuration to the operating configuration and vice versa.

Additionally, between the clamp 16 and the axial abutment on the rotary table 10, there may be interposed elastic means with the aim of preventing mechanical impacts between the two components.

A variant embodiment with respect to the one described above provides for mounting the clamp 16 above the rotary table 10 and connecting it thereto with connection means similar to the bridles or retaining elements 15 described above which allow the connection between the rotary table 10 and the collar 14.

In a further variant, the locking device may be supported by a guide assembly 13, for example a bar guide head of the per se known type, mounted on the mast 5 and adapted to guide the movement of the bank of bars 12 along such mast 5. In this case, the sliding of the bank of telescopic bars 12 with respect to the mast 5 towards the top part of the latter may thus be hindered by the bar guide head 13 which is axially integral with the external bar of the bank of bars 12. This sliding hindrance may be obtained, for example, by providing the bar guide head 13 with locking means 16*b*, such as, for example, jaws, other gripping means, braking elements, or the like which are engaged on the guides of the mast 5. In this case, the bar guide head 13 is generally positioned at a height that cannot be reached by the operator and the opening/closure control of the jaws or braking/release on the guide is preferably a remote control, in other words controllable (manually or in an interlock manner) from a distance by the operator.

Figure 15:
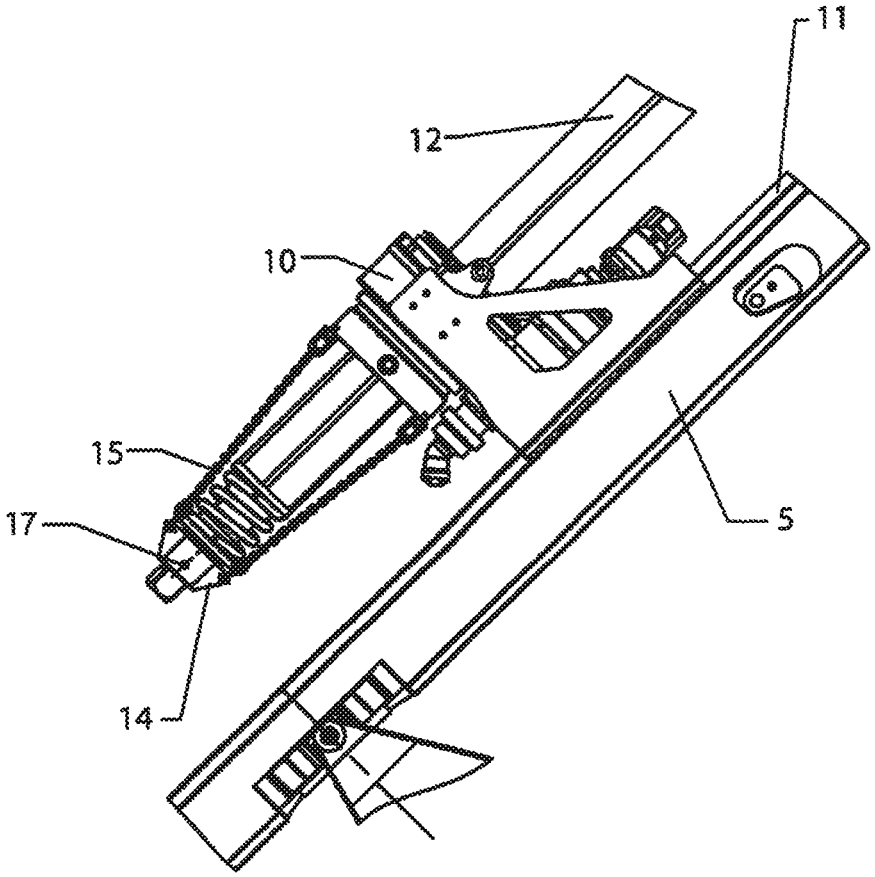
FIG. 15 is a detailed view of a locking device employed in a second embodiment of a control method and system according to the present invention.
Figure 16:
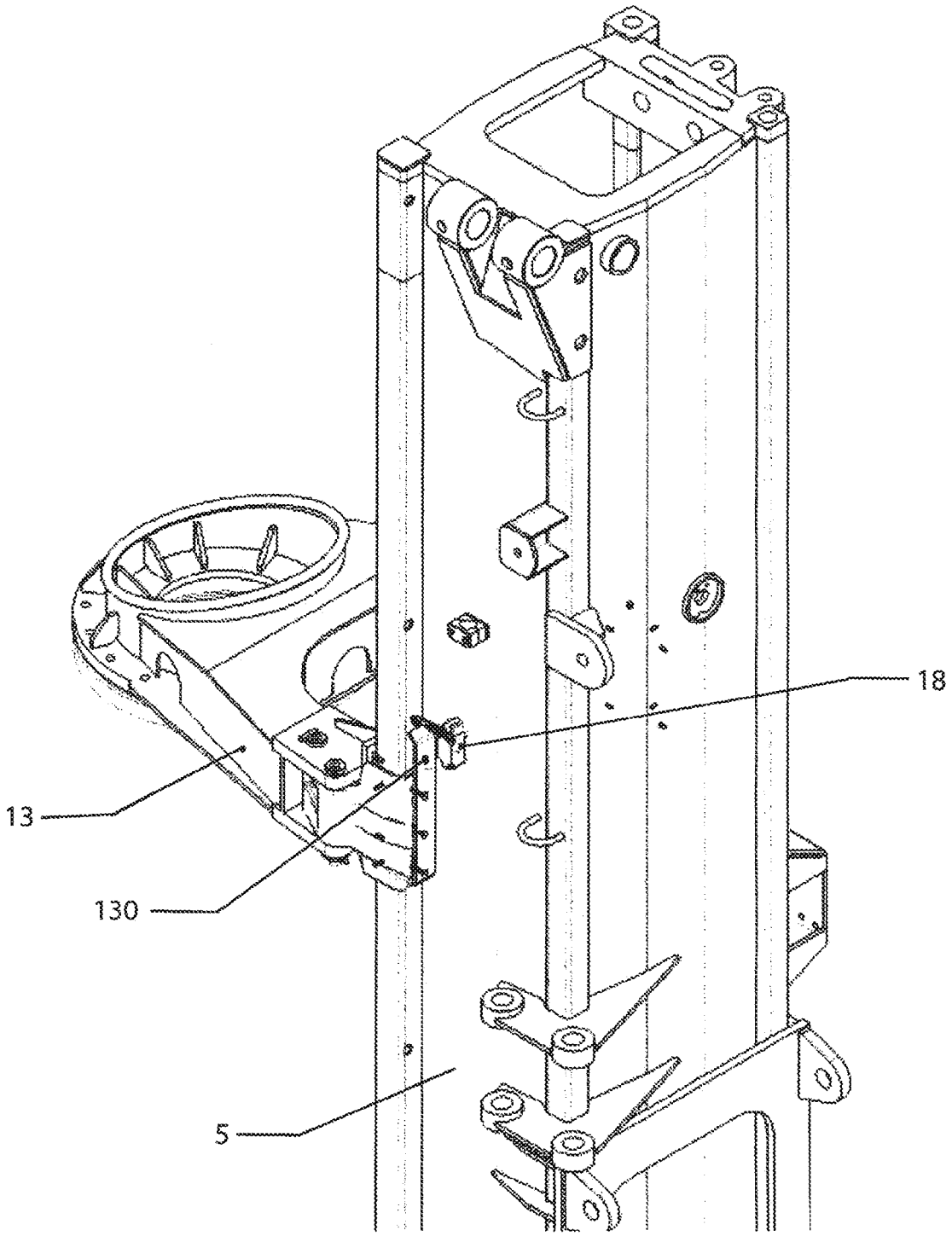
FIG. 16 is a detailed view of a device for detecting the end stroke position of the bar guide head employed in a second embodiment of a control method and system according to the present invention.

In a further embodiment shown in FIG. 15, the locking device comprises the collar 14, the bridle or retaining element 15 and the transverse pin 17, which perform the same functions previously described regarding FIG. 11, but does not require the use of the retention clamp 16. In this case the locking device hinders any axial sliding of the bank of bars 12 with respect to the mast 5 towards the base of the latter but it allows the axial sliding of the bank of bars 12 with respect to the mast 5 towards the top part of the latter. Such solution is advantageous given that it allows avoiding the step of mounting the clamp 16 which is difficult given the considerable weight of the clamp itself and the considerable height at which it should be fixed.

It should be observed that the presence of the transverse pin 17, the retention clamp 16 and the locking means 16*b* are optional characteristics in at least one of the described embodiments.

The axial sliding of the bank of bars 12 towards the top part of the mast, which may occur during the lifting of the mast due to the tensioning of the rope of the main winch connected to the bank of bars 12, is detected and interrupted by using means for detecting the end stroke position of the bar guide head which can guide and provide consent to the delivery of moving power or to the delivery of actuating power. On the bar guide head 13 there is an abutment element, for example a cam 130 suitably shaped to press a switch 18 when the bar guide head (see FIG. 16), which is axially integral to the bank of bars 12, is driven by the bank 12 towards the upper part of the mast. In particular an electric switch 18 is fixed for example in the upper part of the mast 5 in a position such that, when the machine is in transportation condition, like in FIG. 9, the switch is very close to the cam 130, for example a few centimeters, but axially spaced towards the upper part of the mast. Thus, the switch 18 is pressed and thus activated by the cam 130 only when the bank of bars 12 and the bar guide head 13 are subjected to an axial sliding towards the upper part of the mast with respect to the initial lifting position reaching the end stroke position. It should be observed that the collar 14, the bridle or retaining element 15, the retention clamp 16 and the transverse pin 17 are advantageously removable from the drilling machine, in particular it is advantageous to remove them during the operating steps of the drilling machine. Actually, they are preferably mounted on the drilling machine before the step of lowering of the mast 5 for the passage from the operating configuration to the transportation configuration, remaining mounted during the transportation and during the step of lifting the mast 5 for the passage from the transportation configuration to the operating configuration. Thus, in these steps the bank of bars 12 shall be at least temporarily constrained to the mast 5 and at least in a sense along the longitudinal axis of the mast itself. In case the bar is indirectly constrained to the mast 5, by fixing on the rotary table 10, then a small axial positioning (lower than K2) of the kelly bar 12 shall be actuated, by directly acting on the push pull system 11. With reference to FIG. 9, the axial position of the kelly bar 12 along the mast 5, may be preselected with the lower end part of the kelly bar 12 also cantilevered with respect to the lower end of the mast 5 (indicated with K3 in the figure, where K3<K2). Such cantilever should be compatible with the moving kinematism so that during the movements of the mast in the vertical direction, the kelly bar 12 (locked in the sliding towards the base of the mast due to the fact that it is connected to the rotary table 10 through the locking device) does not touch the ground. Thus, the free space K2 is further reduced due to the fact that the kelly bar 12, of greater length equivalent to L3, is lifted when it is in proximity of the operating conditions, thus allowing increasing the drilling depth. Such solution can be easily adopted in the machines that are provided with a moving kinematism like the parallelogram kinematism given that they allow to start the movement of the mast 5 starting from a laid condition lifted with respect to the initial transportation one.

Figure 4:
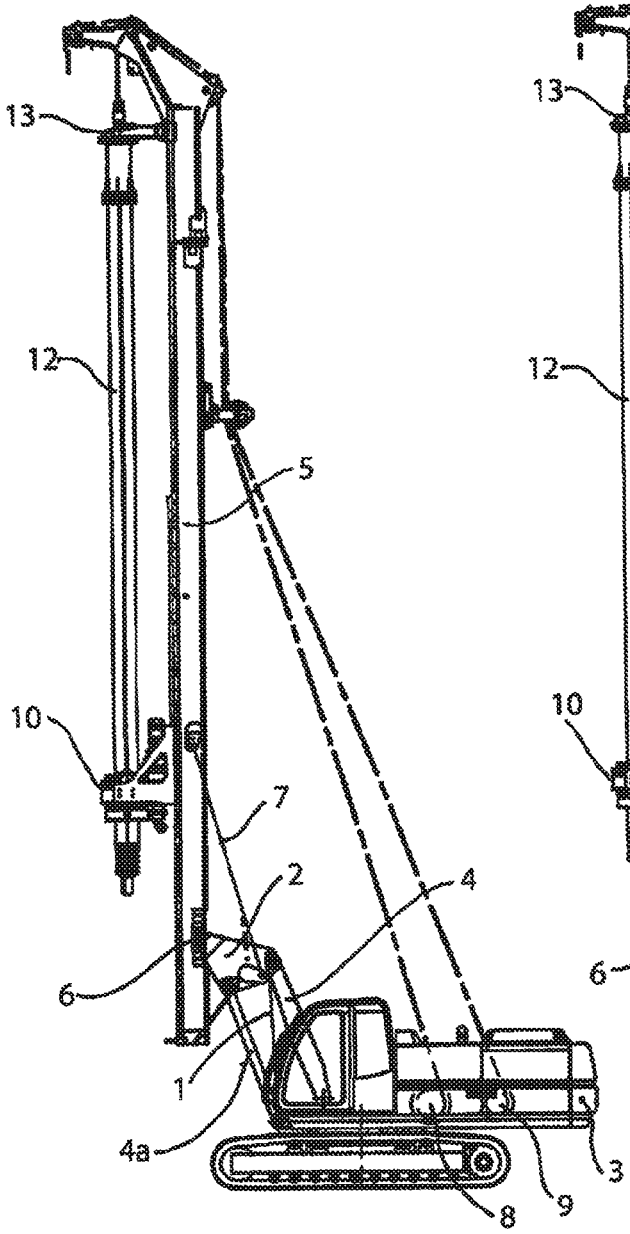
Fig. 4 (PRIOR ART)
FIG. 4 illustrates the machine shown in the preceding figures, wherein it assumes a first operating or minimum radius configuration.
Figure 7:
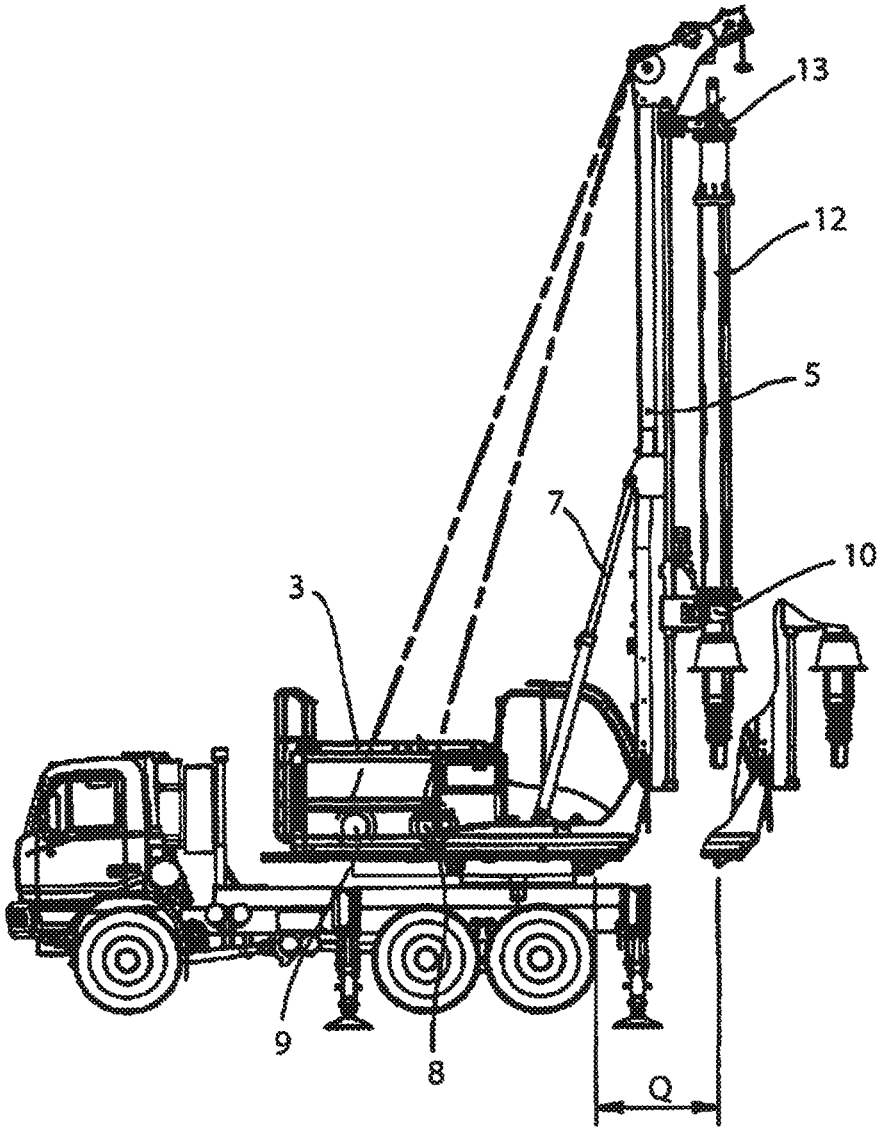
Fig. 7 (PRIOR ART)
FIG. 7 illustrates a further truck-type variant of a drilling machine of the known type for obtaining piles, but without the parallelogram kinematism.
Figure 8:
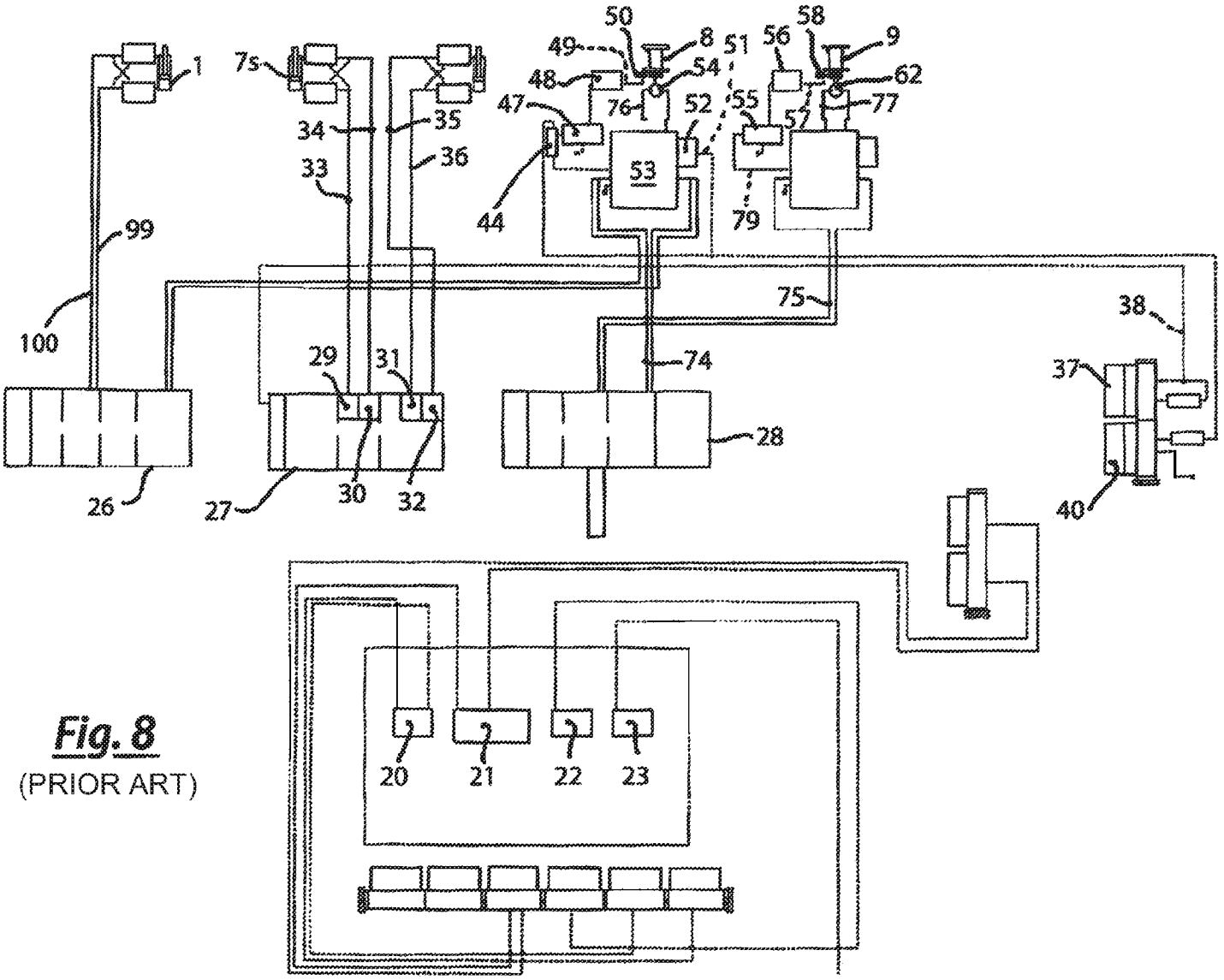
Fig. 8 (PRIOR ART)
FIG. 8 illustrates a block diagram of a control system of the known type and mounted on the drilling machines according to the preceding figures.

Following is a description of an operating step of the drilling machine wherein the mast 5 is brought from the lifted or intermediate configuration illustrated in FIG. 10 (coinciding with the initial step of ascent from the lowered or transportation condition, when the machine is not provided with an articulated kinematism, for example of the parallelogram type, for example analogous to the machine represented in FIG. 7) to the straight or operating configuration (not illustrated but analogous to that shown in FIG. 4).

Preferably, in order to control the aforementioned operating step, the operator acts on an additional switch 25, advantageously of the electrical type, associated to the movement of the mast 5 and, for example, present in the cabin of the self-propelled structure 3. In the illustrated embodiment the switch 25 is distinguished from the standard manipulator indicated with 23, which is instead arranged to be used solely for varying or correcting—manually and conventionally and not automatically—the position of the mast 5 after the latter reaches the straight or operating configuration.

Figure 12:
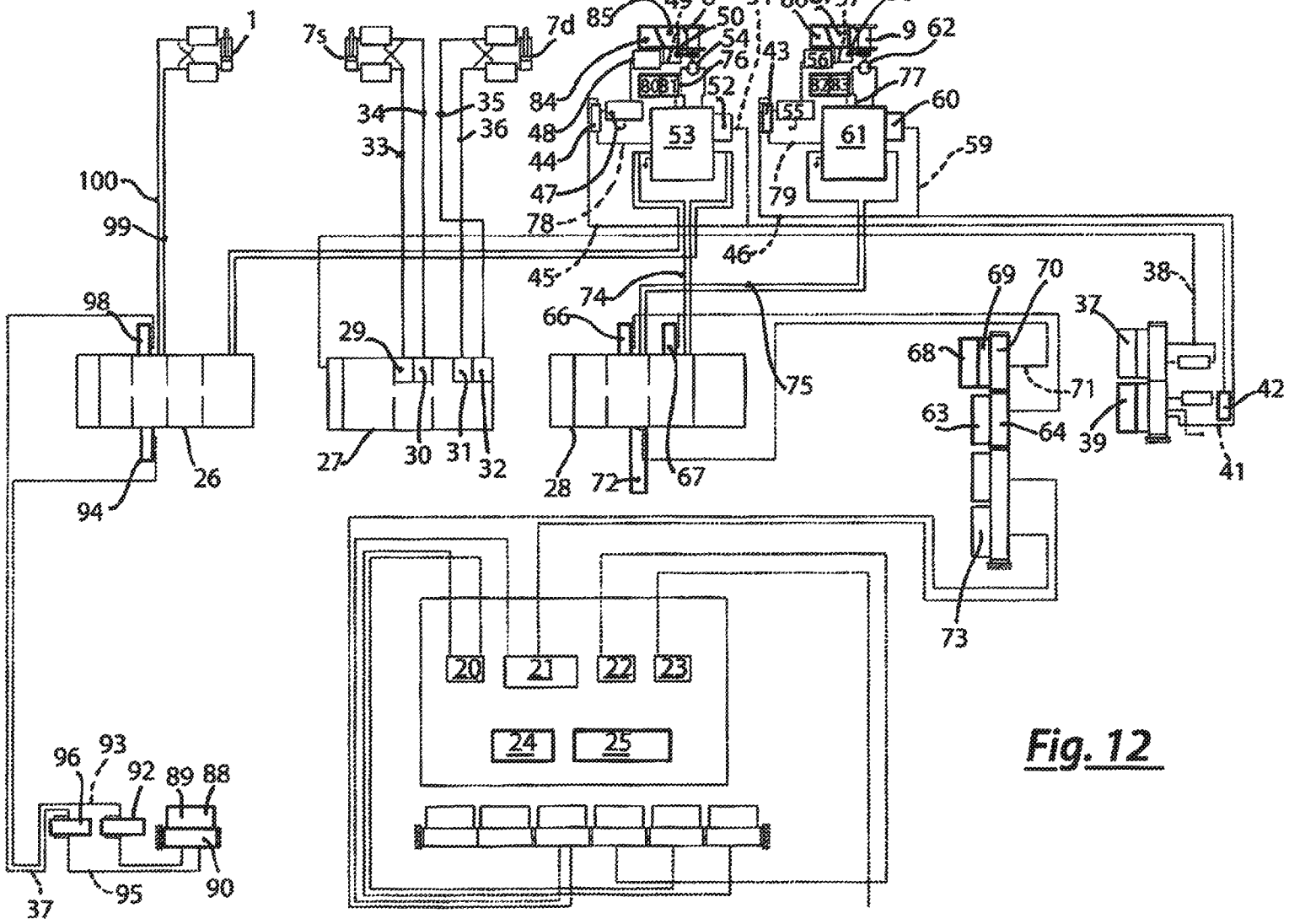
FIGS. 12 to 14 are block diagrams illustrating an exemplifying embodiment of a control system according to the present invention in some operating steps.
Figure 13:
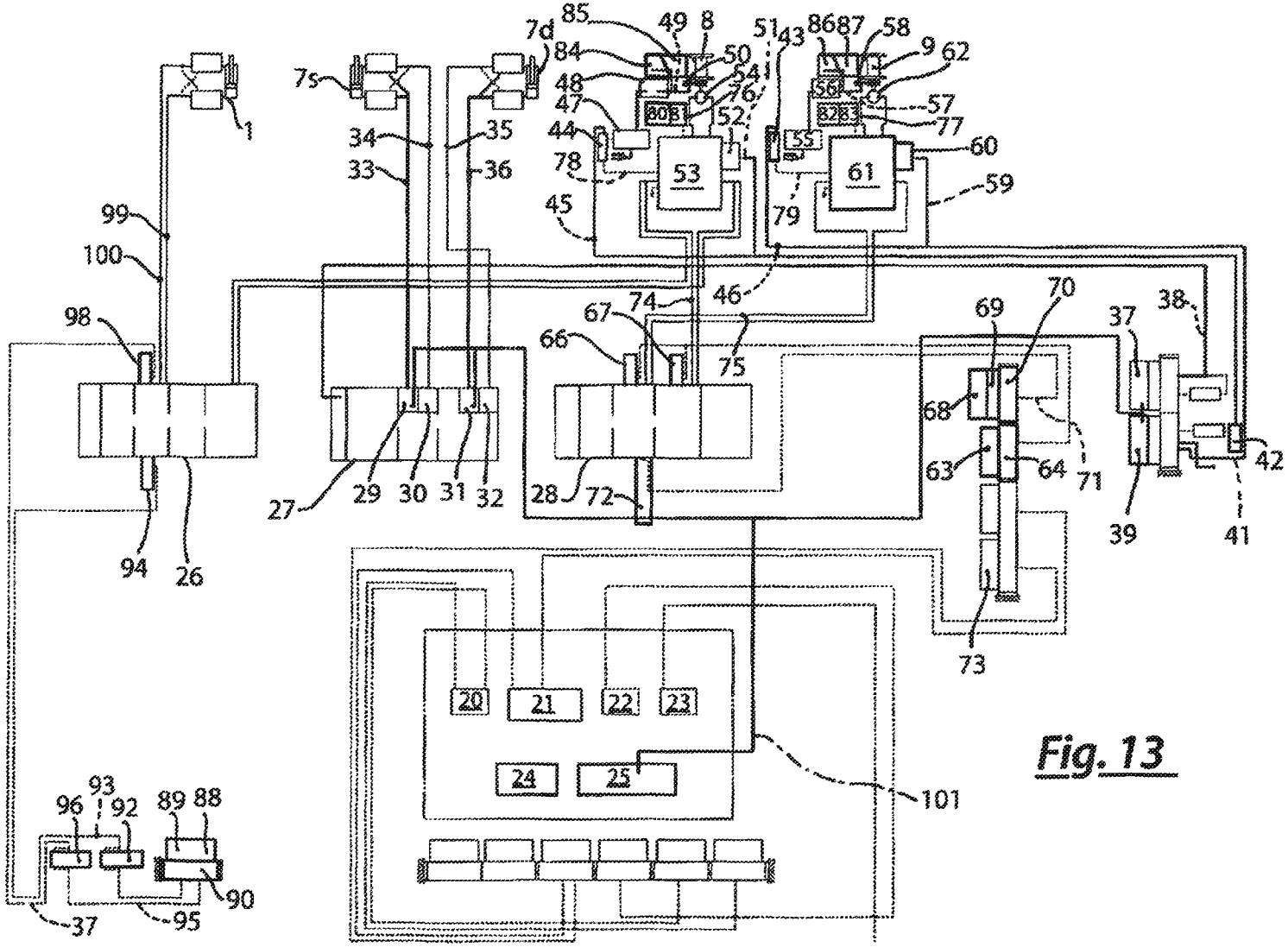

With particular reference to FIG. 12 there is shown an embodiment of the control system, advantageously of the hydraulic type, according to the present invention. FIG. 13 specifically illustrates the operating step of swinging of the mast 5 from the intermediate configuration to the straight configuration. This operating step is preferably triggered by suitably activating the switch 25, possibly moving it in a first predetermined operating position.

Such trigger obtained by activating the switch 25 causes, through the electric line indicated with 101 and visible in FIG. 13, the excitation of a pair of solenoid valves 29 and 31 associated to the hydraulic distributor 27 for delivering a moving power by acting on the control of the lifting of the mast 5. The solenoid valves 29 and 31 control the pressurization of one pair of respective hydraulic lines 33 and 36 and the ensuing extension of the stems of the jack 7*s*, 7*d* associated to the lifting of the mast 5. The solenoid valves 29 and 31 are preferably the same that control the lifting of the mast 5 in the known control system illustrated in FIG. 8.

In addition, a solenoid valve 39 which—through a hydraulic line 38—supplies a guide pressure to the hydraulic distributor 27 for controlling the lifting of the mast is excited still through the electric line 101 observable in FIG. 13.

The solenoid valve 39, advantageously of the double type, configured for delivering the actuating power and thus controlling the release of the rope of the main winch 8 and preferably also the auxiliary winch 9 is simultaneously excited still through the electric line 101 visible in FIG. 13. This solenoid valve 39 is absent in the known control shown in FIG. 8 and it replaces the single solenoid valve 40 present in the aforementioned known control system. The solenoid valve 39, if excited, causes the pressurisation of a hydraulic line 41 and such pressure constitutes the signal which controls the release of the rope of the main winch 8 and the auxiliary winch 9. Due to the addition of a bistable valve 42 the pressurised oil of the line 41 is capable of crossing the aforementioned bistable valve 42 and it may reach both the bistable valve 44 of the system of the main winch 8 through the branch 45 and the bistable valve 43 of the system of the secondary winch 9 through the branch 46. In particular the bistable valve 43 is absent in the known control system illustrated in FIG. 8.

The pressure signal present in the branch 45 crosses the bistable valve 44, switches the switch 47 and allows the guide pressure to freely cross one constriction 48 to reach—through the hydraulic branch 49—the brake 50 of the main winch 8 controlling the opening of such brake 50.

Simultaneously, the pressure signal present in the line 45 through a diversion 51 also reaches a release valve 51 capable of excluding the function of an overcenter valve 53 to which it is connected and causes the idling of a hydraulic motor 54 associated to the main winch 8 through mutual connection of the two motor ports.

Analogously the pressure signal present in the branch 46, crossing the bistable valve 43, switches the switch 55 and allows the guide pressure to freely cross a constriction 56 to reach—through a hydraulic branch 57—a brake 58 of the auxiliary winch 9, thereby controlling the opening of the brake 58.

Simultaneously, the pressure signal present in the line 46 through the diversion 59 also reaches a release valve 60 capable of excluding the function of an overcenter valve 61 to which it is connected and causes the idling of a hydraulic motor 62 associated to the secondary winch 9 (through the mutual connection of the two ports of such engine).

In the conditions described above, further to the actuation to activate the electric switch 25 a lifting of the mast 5 and a simultaneous unlocking of the brakes 50, 58 of the main winch 8 and of the auxiliary winch 9 is obtained. The movement of the mast 5, which tends to move away with a swinging movement from the self-propelled structure 3, causes the tensioning of the respective traction elements of the winches 8 and 9. In turn, the traction elements cause the ensuing driving of the drums of the winches 8 and 9 in rotation, thus allowing the unwinding of the traction elements.

In the illustrated embodiment, the movement of lifting of the mast 5 is allowed solely if:

the pressure detected by pressure sensors 84 and 85 (which operate in pairs to guarantee detection redundancy) in the hydraulic line 49 which supplies the unlocking of the brake 50, and the pressure detected by pressure sensors 86 and 87 (which operate in pairs to guarantee detection redundancy) in the hydraulic line 57 which supplies the unlocking of the brake 58 are higher than a threshold value sufficient to guarantee the unlocking of the aforementioned brakes 50 and 58 associated to the winches 8 and 9.

This allows preventing the mast 5 from being lifted while winches 8 and 9 are locked by the respective brakes 50 and 58, which could lead to structurally damaging the components of the drilling machine and expose the worksite personnel to serious risks.

In the illustrated embodiment, the unlocking of the brakes 50 and 58 of the main winch 8 and of the auxiliary winch 9 during the lifting of the mast 5 from the transportation configuration to the operating configuration is advantageously allowed by the fact that the axial sliding of the bank of telescopic bars 12 with respect to the mast 5 is hindered at least towards the base of the mast itself through the locking device and thus the weight of the bank of bars does not exert a driving force on the ropes of the winches 8 and 9.

Preferably, the fact that the device for direct or indirect locking of the bank of bars 12 to the mast 5 is inserted during the passage of the mast 5 from the transportation configuration to the operating configuration advantageously contributes to hindering a progressive descent or drop of the bank of bars 12, with the risk of serious structural damages. Actually, during such passage, the main winch 8 is not braked and the weight of the bank of bars 12 would risk unrolling of the associated traction element, thus causing the descent thereof.

Figure 17:
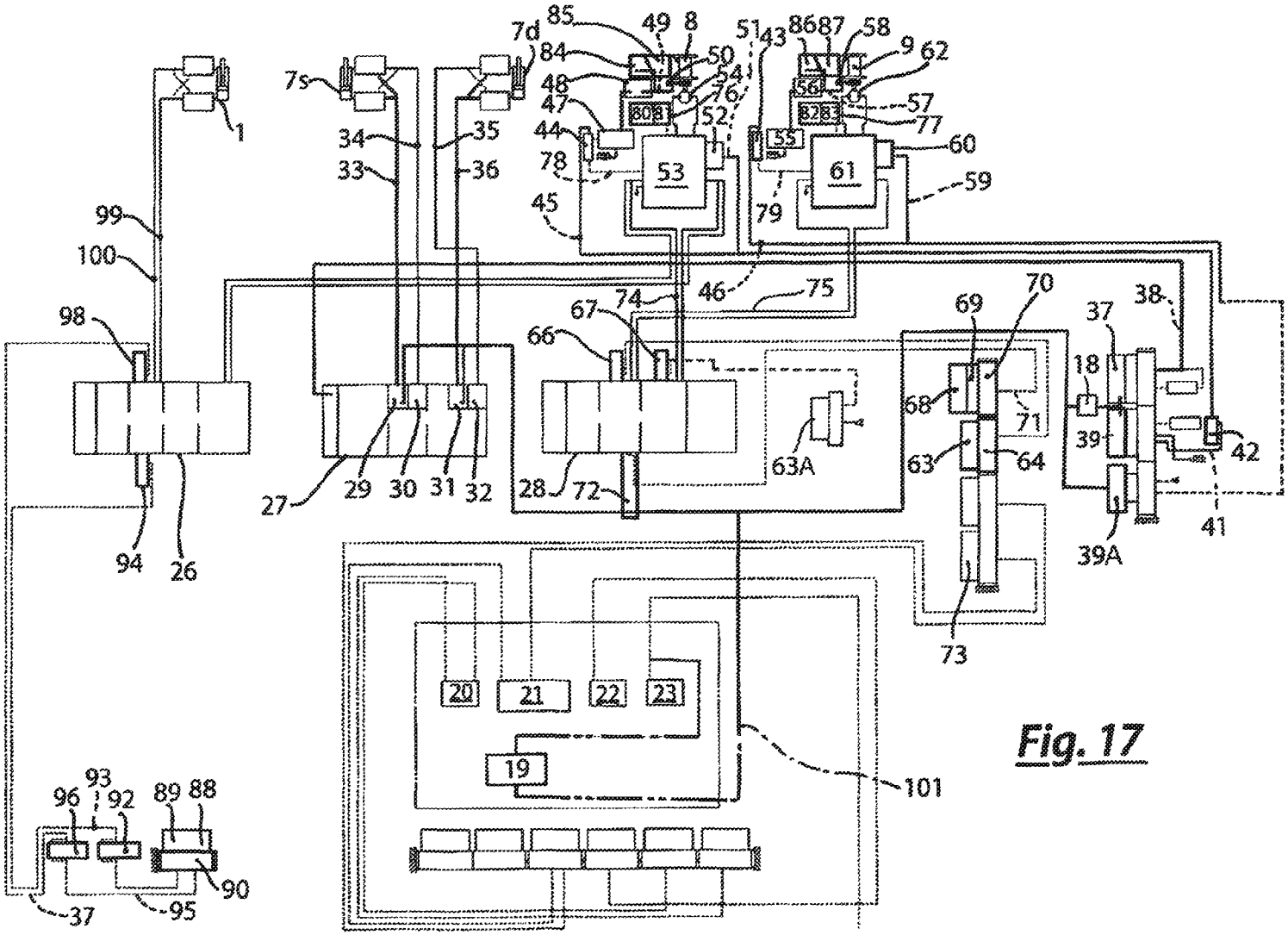
FIGS. 17 and 18 are block diagrams illustrating a second exemplifying embodiment of a control system according to the present invention in some operating steps.
Figure 18:
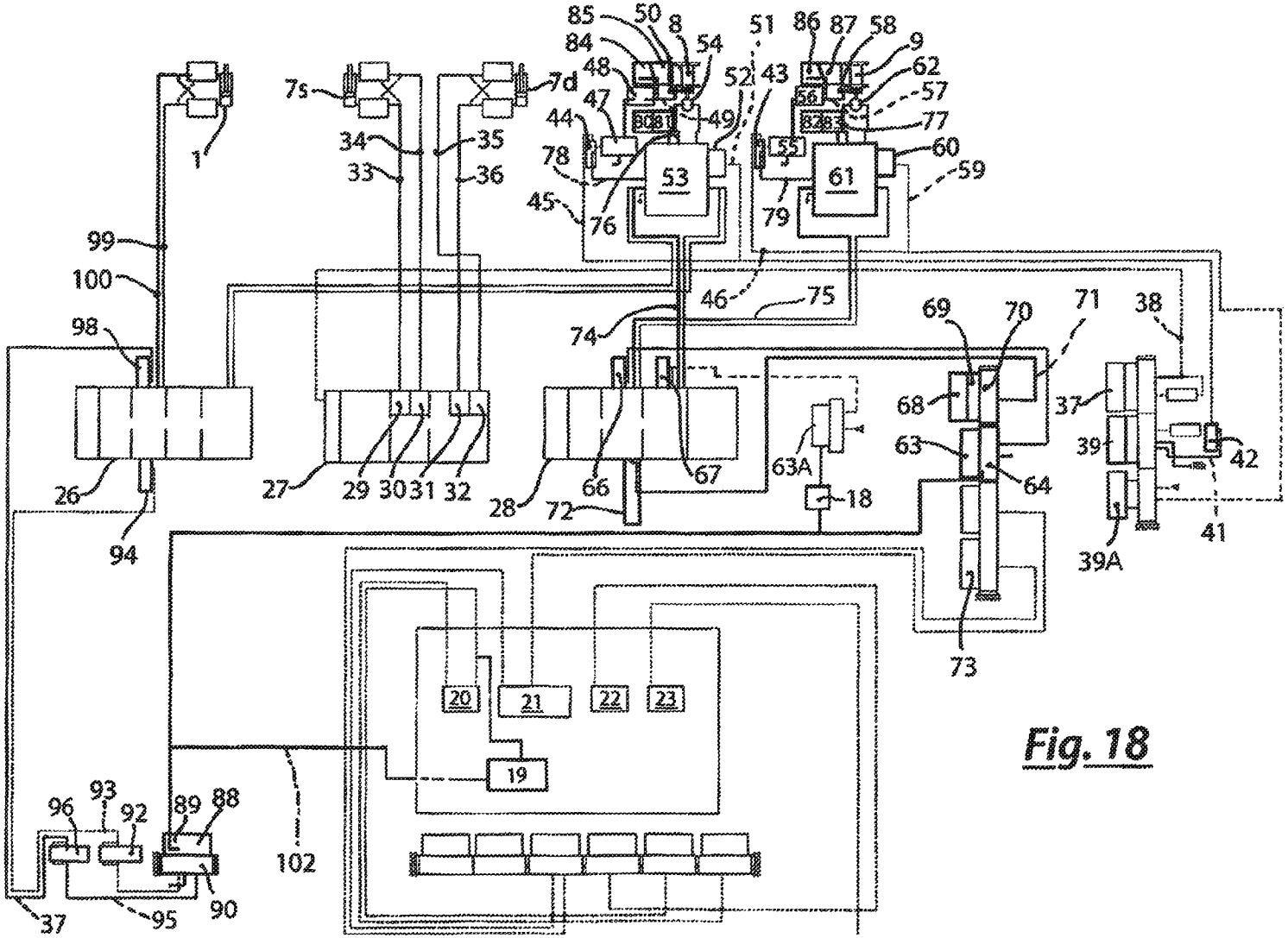

Alternatively, in an illustrated embodiment in FIGS. 17 and 18, it is no longer required to install an additional switch 25 but it is possible to allow the manipulator 23 to perform a double function through a monostable switch 19 of activating the assisted mode. Such monostable switch 19 may for example be installed in the cabin of the self-propelled structure 3. In a first condition in which the monostable switch 19 of the assisted mode is in the inactive position (stable position), the manipulator 23 is used solely for varying or correcting—manually and conventionally and not automatically—the position of the mast 5 after the latter reaches the straight or operating configuration. In a second condition in which the monostable switch 19 of the assisted mode is held in the active position (unstable position) by the operator, the manipulator 23 automatically controls the movement of the mast 5 from the lifted or intermediate configuration illustrated in FIG. 10 to the vertical operating configuration or vice versa. Thus, in this embodiment the system must be modified with respect to that of FIGS. 12, 13 and 14 by adding two solenoid valves 39A, 63A and a monostable switch 19, as shown in FIGS. 17 and 18 so as to be able to manage the delivery of actuating power to the two winches 8 and 9 according to a different logic. The functions of all the remaining components described previously regarding the system of FIGS. 12, 13 and 14 remain unvaried.

The aforementioned operating step for bringing the mast 5 from the lifted or intermediate configuration illustrated in FIG. 10 to the straight or operating configuration is illustrated in FIG. 17 and it may be triggered by the operator by keeping the monostable switch 19 of activating the assisted mode (also referred to as automatic control mode) pressed and by acting simultaneously on the standard manipulator 23 possibly bringing it to a first predetermined operating position. The trigger causes, through the electric line indicated with 101 and visible in FIG. 17, the excitation of a pair of solenoid valves 29 and 31 for delivering a moving power to the mast and the excitation of the solenoid valve 39A for delivering the actuating power and thus controlling the release of the rope of the auxiliary winch 9. The excitation of the solenoid valve 39 may be caused by the electric line 101 solely if the electric switch 18 is in pressed condition. This condition occurs solely if the bank of bars 12 and the bar guide head 13 have been subjected to an axial sliding towards the upper part of the mast 5 such to cause the pressing of the electric switch 18 through the cam 130. The solenoid valve 39, when excited is configured for delivering the actuating power and thus controlling the release of the rope of the main winch.

In the illustrated embodiment, the movement of lifting of the mast 5 is allowed even if the brake 50 of the main winch 8 is temporarily locked. Such movement of the mast with the winch 8 locked causes the tensioning of the traction element of the winch 8 and a sliding of the bank of bars 12 towards the upper part of the mast and a loosening of the bridles 12 until the switch 18 is pressed (with the ensuing closure of contact) by the cam 130 of the bar guide head causing the delivery of actuating power for unlocking the brake 50 of the winch 8. At this point the mast lifting movement continues with the brake 50 unlocked generating the driving of the drum of the winch 8 until the bank of bars tends to slide towards the lower part of the mast due to the weight thereof disengaging the cam 130 from the electric switch 18. Such sliding is allowed solely up to the return of bridles which had been previously loosened to traction and thus having a very limited width. In the illustrated embodiment, during movement of lifting of the mast 5 the brake 50 of the winch 8 is alternatingly locked and unlocked while the brake of the auxiliary winch 9 is preferably unlocked. Thus during such lifting the delivery of the moving power and the delivery of the actuating power are controlled in a coordinated manner so as to keep said traction elements of the winches in a predetermined state of tension.

Following is a description of an operating step of the drilling machine in which the mast 5 is brought from the straight or operating configuration (not illustrated but analogous to that shown in FIG. 4) to the lifted intermediate configuration illustrated in FIG. 10. Should the machine not be provided with a kinematism of the articulated type, such lifted configuration coincides with the transportation configuration.

Preferably, in order to control the aforementioned operating step, the operator acts on the switch 25, for example bringing it to a second predetermined operating position preferably opposite to the aforementioned first predetermined operating position characteristic of the previous operating step.

The activation of the switch 25 causes the excitation of a further pair of solenoid valves 30 and 32 associated to the hydraulic distributor 27 for controlling the moving power for the lowering or descent of the mast 5. The solenoid valves 30 and 32 control the pressurisation of a pair of respective hydraulic lines 34 and 35 and the ensuing return of the stems of the jacks 7*s*, 7*d* associated to the lift of the mast 5.

Furthermore, a further solenoid valve 37 which—through the hydraulic line 38—supplies a guide pressure to the hydraulic distributor 27 for controlling the lifting of the mast 5 is also excited.

Simultaneously, with the aim of imparting an actuating power to obtain a winding of the traction element, there follows the excitation of a further solenoid valve 63 mounted on a block base 64, which controls the pressurisation of a hydraulic line 65 thus sending the guide signal for manoeuvring the winding rope of the main winch 8 and the auxiliary winch 9 which crossing a pair of bistable valves 66 and 67 reaches the distributor 28 for controlling the winches 8, 9. The bistable valves 66 and 67 are absent in the known control system shown in FIG. 8 and allow conveying—to the distributor 28—a hydraulic guide sign for manoeuvring the winding rope of the main winch 8 and the auxiliary winch 9, selectively from the solenoid valve 63 when the ropes are required to be wound during the lowering of the mast 5 or from a solenoid valve 73 when the ropes are required to be wound in operating conditions.

In presence of the aforementioned guide signal, the distributor 28 associated to the control of the winches 8, 9 supplies and pressurises the hydraulic lines 74 and 75, freely crosses the overcenter valve 53 of the motor control and—through the line 76—reaches the motor 54 of the main winch 8, and respectively freely crosses the overcenter valve 61 of the motor control and—through the line 78—reaches the motor 62 of the auxiliary winch 9.

The pressure in the line 76 allows the movement of the motor 54 to wind the rope of the main winch 8 and simultaneously the overcenter valve 53—through the hydraulic line 78—sends the guide hydraulic signal to the bistable valve 44, which switches the switch 47, allows the guide pressure free passage through the constriction 48 to reach—through the hydraulic branch 49—the brake 50 of the main winch 8 controlling the opening of such brake 50 (actuating power).

Analogously, the pressure in the line 78 allows moving the motor 62 for the winding of the rope of the auxiliary winch 8 and simultaneously the overcenter valve 61—through the hydraulic line 79—sends the guide hydraulic signal to the bistable valve 43, which switches the switch 55, and allows the guide pressure free passage through the constriction 56 to reach—through the hydraulic branch 57—the brake 58 of the auxiliary winch 9 controlling the opening of such brake 58.

The activation of the electric switch 25, simultaneously with the excitation of the solenoid valve 63 which controls the previously described movements, also causes the de-excitation of the solenoid valve 68 (normally excited) connected to the maximum pressure valve 69 and to the base block 70. The solenoid valve 68, when de-excited, acts on the maximum pressure valve 69 which reduces the pressure of the guide signal which—through the hydraulic line 71—reaches the maximum pressure valve 72 present on the distributor 28 which determines the maximum supply pressure of the motor 54 of the main winch 8 and of the motor 62 of the auxiliary winch 9 during the manoeuvre of winding rope.

Such supply pressure of the motor of the main winch 8 and of the motor of the auxiliary winch 9 is thus limited to a much lower value with respect to the one attainable during the operating steps. Such pressure is advantageously limited to the minimum value sufficient to guarantee the rotation of the winch 8, 9 with ensuing winding of the rope with the aim of reducing as much as possible the camber thereof (curvature assumed by the traction element or rope) and avoiding possible fleeting or impacts and unwanted hooking. The calibration configuration of the pressure shall be particularly near that of the minimum value which guarantees the ropes to be arranged in configuration close to the straight one.

In the conditions described above, following the actuation of the electric switch 25 there is obtained a lowering of the mast 5, a simultaneous unlocking of the brakes 50, 58 of the main winch 8 and of the auxiliary winch 9, and a simultaneous winding of the ropes of the main winch 8 and of the auxiliary winch 9 with predetermined pull values on the ropes. During the movement of the mast 5, which tends to approach with a swinging movement to the self-propelled structure 3, the ropes are rewound by the winches 8 and 9 which maintain them in traction at a predetermined and settable tension value sufficient to guarantee a correct winding on the drums but sufficiently low not to create hazardous overloads.

In the illustrated embodiment, the movement of lowering the mast from the working to the transportation configuration is allowed solely if:

the pressure detected in the hydraulic line 49 which supplies the unlocking of the brake 50 by the pressure sensors 84 and 85 (which operate in pairs to guarantee detection redundancy), and the pressure detected in the hydraulic line 57 which supplies the unlocking of the brake 58 by the pressure sensors 86 and 87, (which operate in pairs to guarantee detection redundancy), are greater than a threshold value sufficient to guarantee the unlocking of the aforementioned brakes 50 and 58 of the winches 8 and 9.

This allows preventing the mast 5 from being lowered while the winches 8 and 9 are still locked by the respective brakes 50 and 58, hence leading to an unwanted loosening of the ropes with ensuing danger of fleeting them.

In the illustrated embodiment, a further safety control for avoiding overloads to the structure of the drilling machine during the manoeuvre of lowering the mast 5 is ensured by the pressure sensors 80, 81 connected to the overcenter valve 53 and which control the actual operating pressure of the motor of the main winch 8 (operating in pairs to guarantee the detection redundancy). Should such pressure be greater than the calibration pressure provided for the tensioning due to a malfunctioning of the maximum pressure valves 69 and 72, the pressure sensors 80, 81 would control the interruption of the manoeuvres so as to keep the machine under safety conditions.

Analogously, in the illustrated embodiment, there are provided pressure sensors 82 and 83 connected to the overcenter valve 61 which control the actual operating pressure of the motor 62 of the auxiliary winch 9 (operating in pairs to guarantee the detection redundancy).

All the other safety devices, such as for example the cutting control of the ascent end stroke of the rotary table remain active and they have an additional function to that to the main one carried out by the invention illustrated herein.

Preferably the actuating power delivered to at least one from among the winches 8 and 9, contributes to impart an active rotation of the drum of said winch in a controlled manner so as to wind the traction element (rope) on said drum during a movement between the operating configurations with the aim of lowering or descent of said mast 5 with respect to the self-propelled structure 3.

In an alternative solution, the aforementioned operating step for moving the mast 5 from the straight or operating configuration to the lifted intermediate configuration illustrated in FIG. 10 may be triggered by the operator maintaining the monostable switch 19 of the assistance mode in activated position and suitably activating the manipulator 23, for example bringing it in a second predetermined operating position preferably opposite to the aforementioned first predetermined operating position characteristic of the previous operating step. Such trigger causes the excitation of a pair of solenoid valves 30 and 32 for controlling the moving power for the lowering or descent of the mast 5 and the excitation of a further solenoid valve 63 with the aim of imparting an actuating power to obtain a winding of the traction element of the auxiliary winch 9. The solenoid valve 63A instead is excited solely if the electric switch 18 is in the non-pressed condition. This condition occurs solely if the position of the bank of bars 12 and of the bar guide head 13 is sufficiently spaced from the switch 18 to prevent the pressing thereof through the cam 130. The solenoid valve 63A—when excited—imparts an actuating power to obtain a winding of the traction element of the main winch 8. In the illustrated embodiment, in the condition described above with the excited solenoid valves 63, 63A, there is obtained a lowering of the mast 5, a simultaneous unlocking of the brakes 50, 58 of the main winch 8 and of the auxiliary winch 9, and a simultaneous winding of the ropes of the main winch 8 and of the auxiliary winch 9 with predetermined pull values on the ropes. Due to the pull present on the traction element of the main winch there may occur an axial sliding of the bank of bars 12 and of the bar guide head towards the upper part of the mast 5 with ensuing loosening of the bridles 15. When such sliding is sufficient to cause the pressing of the electric switch 18 by the cam 130, the winding of the rope of the main winch is interrupted until the bank of bars tends to slide towards the lower part of the mast due to the weight thereof disengaging the cam 130 from the electric switch 18. Such sliding is possible solely up to the return of the bridles—which had been previously loosened—to traction and thus will have a very limited width.

Following is a description of an operating step of the drilling machine which is provided—in the illustrated embodiment—with a parallelogram kinematism and which may be indistinguishably provided with a crawler truck or wheeled truck. In such operating step the mast 5 is brought from the transportation configuration, illustrated in FIG. 9, to the lifted configuration, illustrated in FIG. 10, through an actuation of the arm 4.

Preferably, in order to control the aforementioned operating step, the operator acts on an additional switch 24, advantageously of the electrical type, associated to the movement of the arm 4 and for example present in the cabin of the self-propelled structure 3. In the illustrated embodiment the switch 24 is distinguished from the standard manipulator 20 which is instead used solely for adjusting the operating radius of the mast 5 when the drilling machine is in the straight or operating configuration (not illustrated but analogous to FIGS. 4 and 5).

The lifting or ascent of the mast 5 from the transportation configuration to the intermediate configuration is carried out, for example, by imparting a moving power to the mast 5 and an actuating power to the winch 8, by activating the electric switch 24 in a first predetermined operating position.

The activation of the switch 24 causes the excitation of the solenoid valve 88 mounted on the base block 90 (not present in the known control system) and which controls the pressurization of the hydraulic line 91 thus sending the guide signal of the manoeuvre of lifting the arm 4. This guide signal, after crossing the unidirectional pressure reduction valve 92 continues at reduced pressure in the hydraulic line 93 and crossing the bistable valve 94 it reaches the distributor 26 for controlling the arm 4 thus enabling the lifting of the arm 4 (moving power). The distributor 26, guided by such signal, supplies the hydraulic line 99 causing the extension of the cylinder 1 arranged to lift the arm 4 and, thus, the ensuing lifting of the arm 4. To the reduced guide pressure there corresponds a low speed of actuation of the cylinder 1 which is advantageous in that it makes the manoeuvre of moving away from the transportation configuration more controllable. Thus, the additional bistable valve 94 with respect to the known control system described previously allows selectively supplying to the distributor:

a reduced pressure guide coming from the line 94 during the lifting of the arm 4 with the drilling machine in transportation configuration; or a high pressure guide when performing the lifting of the arm 4 through the hydraulic manipulator 20 of the conventional type in operating configuration.

Simultaneously with the activation of the electric switch 24 in the aforementioned first position there is excited the double solenoid valve 39 intended to release the ropes associated to the main winch 8 and the auxiliary winch 9 (actuating power for the auxiliary actuation of the winch). This solenoid valve 39, absent in the control system of the known type mentioned above, replaces the single solenoid valve 40 present in the known control system. The solenoid valve 39 is advantageously double and, if excited, it is intended to cause the pressurisation of the hydraulic line 41 and such pressure represents the signal which controls the release of the ropes of the main winch 8 and of the auxiliary winch 9.

Due to the addition of the bistable valve 42, the pressurised oil of the line 41 crossing such bistable valve 42 may reach the bistable valve 44 of the system of the main winch 8 through the branch 45 and the bistable valve 43 of the system of the secondary winch 9 (also absent in the known control system) through the branch 46. The pressure signal present in the branch 45, crossing the bistable valve 44, switches the switch 47 and allows the guide pressure to freely cross the constriction 48 to reach—through the hydraulic branch 49—the brake 50 of the main winch 8 controlling the opening of such brake 50 (actuating power). Simultaneously, the pressure signal present in the line 45 through the diversion 51 also reaches the release valve 51 which excludes the operation of the overcenter valve 53 to which it is connected and causes the idling of the hydraulic motor 54 of the main winch 8 (through the mutual connection of the two ports of the motor).

Analogously the pressure signal present in the branch 46, crossing the bistable valve 43, switches the switch 55 and allows the guide pressure to cross the constriction 56 to reach through the hydraulic branch 57 the brake 58 of the auxiliary winch 9 controlling the opening of such brake 58.

Simultaneously, the pressure signal present in the line 46 through the diversion 59 also reaches the release valve 60 which excludes the operation of the overcenter valve 61 to which it is connected and causes the idling of the hydraulic motor 62 of the auxiliary winch 9 (through the mutual connection of the two ports of the motor).

Under the conditions described above, following the actuation of the electric switch 24 in the first position a lifting of the arm 4 is obtained, and thus an upward movement of the mast 5 which is lifted keeping it horizontal, along with a simultaneous unlocking of the brakes 50, 58 of the main winch 8 and of the auxiliary winch 9. The movement of the mast 5, which tends to move away from the self-propelled structure 3, causes the traction of the rope of the winches 8, 9 which in turn, cause the ensuing driving of the drums of the winches 8, 9 in rotation hence allowing the unwinding of such ropes. In such case the winches 8, 9 are advantageously subjected to a passive unwinding. Thus, the moving power delivered to the mast 5 contributes to the unwinding of said traction element from the drum of the winch 8 and/or 9 when the mast 5 and in particular the return head with the pulleys, moves away from the turret 3, for example passing from the rear laid operating configuration to the lifting or ascent configuration.

The movement of lifting the arm 4 performed with the moving power, is allowed solely if:

the pressure detected in the hydraulic line 49 which supplies the unlocking of the brake 50 by the pressure sensors 84 and 85, and the pressure detected in the hydraulic line 57 which supplies the unlocking of the brake 58 by the pressure sensors 86 and 87 are greater than a value sufficient to guarantee the unlocking of the aforementioned brakes 50, 58 of the winches 8, 9.

This allows preventing the arm 4 from being lifted while the winches 8 and 9 are locked by the respective brakes 50 and 58, which could lead to structurally damaging the components of the machine and exposing the worksite personnel to serious risks.

In the illustrated embodiment the unlocking of the brakes 50, 58 of the main winch 8 and of the secondary winch 9 during the lifting of the mast 5 from the transportation configuration to the intermediate configuration is advantageously also made possible thanks to the fact that the axial sliding of the bank of telescopic bars 12 with respect to the mast 5 is hindered at least towards the base of the mast itself through the locking device and thus the weight of the bank of bars does not exert forces on the ropes of the winches 8 and 9.

In an alternative solution the aforementioned operating step for bringing the mast 5 from the transportation configuration, illustrated in FIG. 9, to the lifted configuration, illustrated in FIG. 10, through the actuation of the arm 4, may be triggered by the operator by keeping the monostable switch 19 for activating the assisted mode (also referred to as the automatic control mode) pressed and by simultaneously acting on the standard manipulator 20 possibly bringing it in a first predetermined operating position.

The trigger causes the excitation of the solenoid valve 88 for delivering a moving power to the arm 4 and the excitation of the solenoid valve 39A for delivering the actuating power and thus controlling the release of the rope of the auxiliary winch 9. The excitation of the solenoid valve 39 may instead be caused only if the electric switch 18 is in the pressed condition. This condition occurs solely if the bank of bars 12 and the bar guide head 13 have undergone an axial sliding towards the upper part of the mast 5 such to cause the pressing of the electric switch 18 through the cam 130. The solenoid valve 39, when excited is configured for delivering the actuating power and thus controlling the release of the rope of the main winch 8. In the illustrated embodiment, during movement of lifting the mast 5 through the movement of the arm 4 the brake 50 of the winch 8 is alternatingly locked and unlocked while the brake of the auxiliary winch 9 is unlocked. Thus, during such lifting the delivery of the moving power and the delivery of the actuating power are controlled in a coordinated manner so as to keep said traction elements of the winches in a predetermined state of tension.

Figure 14:
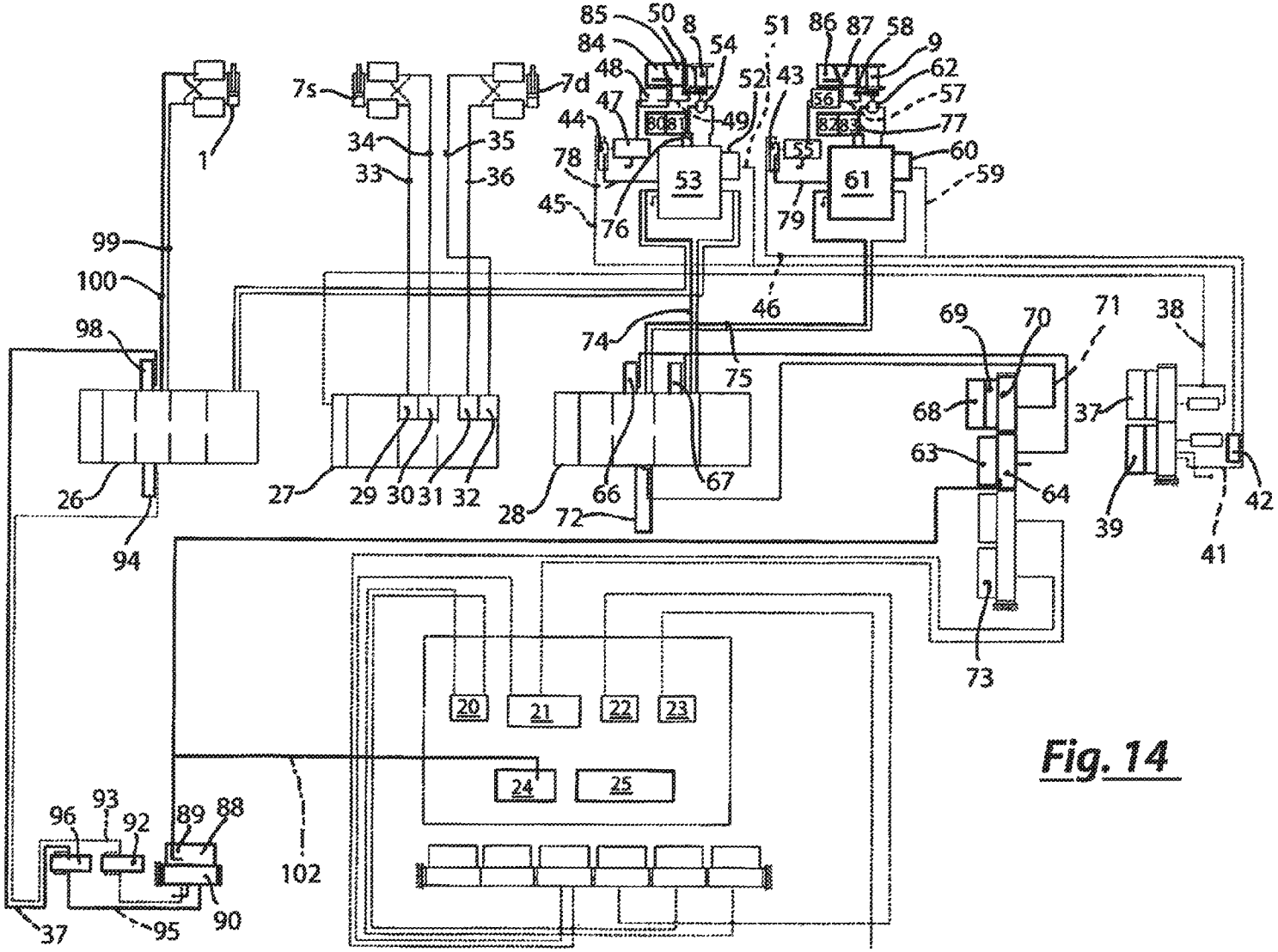

With particular reference to FIG. 14, following is a description of an operating step of the drilling machine, wherein the mast is moved from the lifted configuration, shown in FIG. 10, to the transportation configuration, shown in FIG. 9 through an actuation of the arm 4.

Preferably, in order to control the aforementioned operating step, the operator acts on the additional switch 24 for example, by activating it in a second predetermined operating position and conveniently opposite to the aforementioned first operating position.

The activation causes, through the electrical line 102 shown in FIG. 14, the excitation of the solenoid valve 89 mounted on the base block 90 (and not present in the known control system) which controls the pressurisation of the hydraulic line 95, thus sending the guide signal of the manoeuvre of lowering the arm 4. This guide signal, after crossing the unidirectional pressure reducer valve 96, continues at reduced pressure in the hydraulic line 97 and—crossing the bistable valve 98—it reaches the distributor 26 for controlling the arm 4, thus enabling lowering the arm. The distributor 26, guided by such signal, supplies the hydraulic line 100 causing the return of the stem of the cylinder 1 intended for lifting the arm 4 and, thus, the ensuing lowering of the arm 4. To the reduced guide pressure there corresponds a reduced actuation speed of the cylinder 1 which is advantageous in that it makes the manoeuvre of approaching to the transportation configuration more controllable. Thus, the bistable valve 98 additional with respect to the known control system described previously allows selectively supplying to the distributor:

a reduced pressure guide coming from the line 97 during the lowering of the arm 4 with the drilling machine in the lifted or intermediate configuration; or a high pressure guide when performing the lowering of the arm through the hydraulic manipulator 20 in the straight or operating configuration to increase the operating radius.

The solenoid valve 63 mounted on the base block 64 and which controls the pressurization of the hydraulic line 65 thus sending the guide signal for manoeuvring the winding of the rope of the main winch 8 and of the auxiliary winch 9 is moreover excited simultaneously with the activation of the electric switch 24 in the aforementioned second position.

The aforementioned guide signal—crossing the bistable valves 66 and 67—reaches the distributor 28 intended for controlling the winches 8 and 9. In the illustrated embodiment the bistable valves 66 and 67, absent in the known control system, allow supplying to the distributor 28 the guide hydraulic signal of the manoeuvre of winding the rope of the main winch 8 and of the auxiliary winch 9 selectively from the solenoid valve 63 when they are required to wind the ropes during the lowering of the mast 5 from the intermediate of lifted configuration; or from the solenoid valve 73 (present in the control system of the known system) when they are required to wind the ropes in the operating configuration.

In the presence of the aforementioned guide signal, the distributor 28—adapted to control the winches 8 and 9—supplies and pressurises hydraulic lines 74 and 75, crosses the overcenter valve 53 for controlling the motor and—through the line 76—it reaches the motor 54 of the main winch 8, and respectively crosses the overcenter valve 61 for controlling the motor and—through the line 77—it reaches the motor 62 of the auxiliary winch 9.

The pressure in the line 76 controls the movement of the motor 54 adapted for the winding of the rope of the main winch 8. Simultaneously the overcenter valve 63 through the hydraulic line 78 sends the hydraulic guide signal which—crossing the bistable valve 44—switches the switch 47 and allows the guide pressure to freely cross the constriction 48 to reach—through the hydraulic branch 49—the brake 50 of the main winch 8 controlling the opening of such brake 50.

The pressure in the line 77 controls the movement of the motor 62 adapted for the winding of the rope of the auxiliary winch 8. Simultaneously the overcenter valve 61—through the hydraulic line 79—sends the hydraulic guide signal which—crossing the bistable valve 43—switches the switch 55, and allows the guide pressure to freely cross the constriction 56 to reach—through the hydraulic branch 57—the brake 58 of the auxiliary winch 9, controlling the opening of such brake 58.

The activation of the electric switch 24 in the aforementioned second position, simultaneously with the excitation of the solenoid valve 63, which controls the previously described movements, also causes the de-excitation of the solenoid valve 68 (normally excited) connected to the maximum pressure valve 69 and to the base block 70. The solenoid valve 68, when de-excited, acts on the maximum pressure valve 69 which reduces the pressure of the guide signal which—through the hydraulic line 71—reaches the maximum pressure valve 72 present on the distributor 28, which determines during the manoeuvre of winding of the rope the maximum supply pressure of the motor 54 of the main winch 8 and the maximum supply pressure of the motor 62 of the auxiliary winch 9.

The supply pressure of the motor 54 of the main winch 8 and of the motor 62 of the auxiliary winch is thus limited to a much lower value with respect to the one attainable during the straight or operating configuration. Such pressure is advantageously limited to the minimum value sufficient to guarantee the rotation of the winch with ensuing winding of the rope with the aim of reducing the camber thereof.

In the illustrated embodiment, the movement of lowering the arm 4 from the intermediate configuration in which the mast 5 is in laid and lifted position (FIG. 10) to the transportation configuration in which the mast 5 is in laid and lowered position (FIG. 9) is allowed solely if:

the pressure present in the hydraulic line 49 which supplies the unlocking of the brake 50 and detected by the pressure sensors 84 and 85, (which operate in pairs to guarantee detection redundancy), and the pressure present in the hydraulic line 57 which supplies the unlocking of the brake 58 and detected by the pressure sensors 86 and 87, (which operate in pairs to guarantee detection redundancy)

are greater than a predetermined threshold value sufficient to guarantee the unlocking of the aforementioned brakes 50, 58 of the winches 8, 9.

This allows preventing the mast 5 from being lowered while the winches 8, 9 are still locked by the brakes 50 and 58, hence leading to an unwanted loosening of the ropes with ensuing danger of fleeting them.

Preferably a further safety control for avoiding overloads to the structure of the machine during the manoeuvre of lowering the mast 5 is ensured by the pressure sensors 80, 81 connected to the overcenter valve and which control the actual operating pressure of the motor of the main winch 8 (operating in pairs to guarantee the detection redundancy). Should such pressure be greater than the calibration pressure provided for the tensioning due to a malfunctioning of the maximum pressure valves 69 and 72, the pressure sensors 80 and 81 would control the interruption of the manoeuvres so as to keep the drilling machine under safety conditions.

The pressure sensors 82 and 83 connected to the overcenter valve 61 which control the actual operating pressure of the motor 62 of the auxiliary winch 9 (operating in pairs to guarantee the detection redundancy) operate likewise.

Thus, in the condition described above, following the actuation of the electric switch 24 in the aforementioned second position, there is obtained a lowering of the arm 4, a simultaneous unlocking of the brakes 50 and 58 of the main winch 8 and of the auxiliary winch 9, and a simultaneous winding of the ropes of the main winch 8 and of the secondary winch with predetermined pull values on the ropes. During the movement of the arm 4 in which the mast 5 is kept at laid, substantially horizontal, position and tends to approach the self-propelled structure, the ropes are rewound by the winches 8 and 9 which maintain them stressed in traction at a predetermined and settable tension value, sufficiently high to guarantee a correct winding on the drums of the winches but sufficiently low to avoid creating hazardous overloads.

FIG. 18 shows an alternative solution the aforementioned operating step for bringing the mast from the lifted configuration to the transportation configuration through an actuation of the arm 4, and it may be triggered by the operator by keeping the monostable switch 19 for activating the assisted mode (also referred to as automatic control mode) pressed and by simultaneously acting on the standard manipulator 20 possibly bringing it in a second predetermined operating position and conveniently opposite to the aforementioned first operating position.

The trigger causes the excitation of the solenoid valve 89 which thus sends the guide signal of the manoeuvre of lowering the arm 4. In addition the solenoid valve 63 which thus sends the guide signal of the manoeuvre of winding the rope of the auxiliary winch 9 through the electrical line 102 visible in FIG. 19 is excited. The excitation of the solenoid valve 63A may be caused by the electrical line 102 solely if the electric switch 18 is in the non-pressed condition. This condition occurs solely if the position of the bank of bars 12 and of the bar guide head 13 is sufficiently spaced from the switch 18 so as to prevent the pressing thereof through the cam 130. The solenoid valve 63A, when excited, imparts an actuating power for obtaining a winding of the traction element, of the main winch 8. Should the bank of bars 12 and the bar guide head 13 undergo an axial sliding towards the upper part of the mast 5 such to cause the pressing of the electric switch 18 through the cam 130, the solenoid valve 63A is de-excited interrupting the winding of the traction element of the main winch 8. In the illustrated embodiment, in the condition described above with the solenoid valves 63, 63A excited, there is obtained a lowering of the mast 5 through actuation of the arm 4, a simultaneous unlocking of the brakes 50, 58 of the main winch 8 and of the auxiliary winch 9, and a simultaneous winding of the ropes of the main winch 8 and of the auxiliary winch 9 with predetermined pull values on the ropes.

Following is the description of an operating step of the drilling machine where the mast 5 is brought to:

from the straight or operating configuration or from the lifted or intermediate configuration to a left swinging inclined configuration.

Preferably in order to control the aforementioned operating step, the operator acts on the additional switch 25 bringing it in a third predetermined operating position different from the previous predetermined positions.

The activation of the switch 25 causes the excitation of the solenoid valves 30 and 31 present in the hydraulic distributor 27 adapted to control the arm 4. Such solenoid valves 30 and 31 are adapted to control the pressurisation of the hydraulic lines 34 and 36 and the ensuing extension of the jack 7*d* and the ensuing return of the cylinder 7*s*, both adapted to the movement of the mast 5.

In addition, there is the de-excitation of the solenoid valve 37 which supplies—through the hydraulic line 38 to the hydraulic distributor 27 adapted to control the mast 5—a reduced pressure guide to make the manoeuvre particularly slow.

The double solenoid valve 39 intended for controlling the release of the ropes of the main winch 8 and the auxiliary winch 9 is excited simultaneously. This solenoid valve 39—absent in the known control system shown in FIG. 8—replaces the single solenoid valve 40 present in the aforementioned known control system. The double solenoid valve 39, if excited, causes a pressurisation of the hydraulic line 41 and such pressure represents the signal which controls the release of the rope of the main winch 8 and of the auxiliary winch 9.

Due to the bistable valve 42, the pressurised oil of the line 41 crossing such bistable valve 42 may reach the bistable valve 44 of the system of the main winch 8 through the branch 45, and the bistable valve 43 of the system of the secondary winch 9 through the branch 46.

The pressure signal present in the branch 45, crossing the bistable valve 44, switches the switch 47 and allows the guide pressure to freely cross the constriction 48 to reach—through the hydraulic branch 49—the brake 50 of the main winch 8 controlling the opening of such brake 50.

Simultaneously, the pressure signal present in the line 45—through the diversion 51—also reaches the release valve 51 which excludes the operation of the overcenter valve 53 to which it is connected and causes the idling of the hydraulic motor 54 of the main winch 8 (through the mutual connection of the two ports of the motor).

Analogously the pressure signal present in the branch 46, crossing the bistable valve 43, switches the switch 55 and allows the guide pressure to freely cross the constriction 56 to reach, through the hydraulic branch 57, the brake 58 of the auxiliary winch 9 controlling the opening of such brake 58.

Simultaneously, the pressure signal present in the line 46 through the diversion 59 also reaches the release valve 60 which excludes the operation of the overcenter valve 61 to which it is connected and causes the idling of the hydraulic motor 62 of the auxiliary winch 9 (through the mutual connection of the two ports of the motor).

In the condition described above, following the actuation of the electric switch 25 in the aforementioned third operating position there is obtained a leftward swinging of the mast 5 and a simultaneous unlocking of the brakes 50 and 58 of the main winch 8 and of the auxiliary winch 9. The movement of the mast 5, which tends to move away from the self-propelled structure, rotationally swinging around the horizontal axis defined by the articulated joint, causes the tensioning of the ropes associated to the winches 8 and 9 and the ensuing driving of the drums of such winches in rotation, hence allowing the unwinding of the aforementioned ropes.

Such swinging movement of the mast is allowed solely if the pressure present in the hydraulic line 49 which supplies the unlocking of the brake 50 and detected by the pressure sensors 84 and 85 (which operate in pairs to guarantee detection redundancy), and the pressure present in the hydraulic line 57 which supplies the unlocking of the brake 58 and detected by the pressure sensors 86 and 87, (which operate in pairs to guarantee detection redundancy)

are greater than a predetermined threshold value sufficient to guarantee the unlocking of the aforementioned brakes associated to the winches 8 and 9.

This allows preventing the mast 5 from being subjected to swinging while the winches 8 and 9 are locked by the respective brakes, which could lead to structurally damaging the components of the machine and expose the worksite personnel to serious risks.

In the outlined embodiment, the unlocking of the brake of the main winch 8 and of the brake of the auxiliary winch 9 during the swinging of the mast 5 from the straight or operating configuration is allowed given that during such step the axial sliding of the bank of telescopic bars 12 with respect to the mast 5 is hindered at least towards the base of the mast itself through the locking device and thus the weight of the bank of bars does not exert forces on the ropes of the winches 8, 9.

As regards a rightward swinging of the mast 5 from the straight or operating configuration to the inclined or swinging configuration, a principle analogous to the leftward swinging one described above is applied with suitable adjustments.

For example, in the case of the rightward swinging, there is preferably performed an activation of the electric switch 25 in a fourth predetermined operating position, which causes the excitation of the solenoid valves 29 and 32 present in the hydraulic distributor 27 intended to control the arm 4. The solenoid valves 29 and 31 control the pressurisation of the hydraulic lines 33 and 35 and the ensuing extension of the jack 7*s*, and the return of the cylinder 7*d* adapted to swing the mast 5 with respect to a horizontal axis defined by the articulated joint.

In an alternative solution the aforementioned operating step for bringing the mast from the lifted or from the vertical configuration to the swinging configuration, by actuating the cylinders 7*d*, 7*s*, may be triggered by the operator by keeping the monostable switch 19 for actuating the assisted mode (also referred to as automatic control mode) pressed and by simultaneously acting on the standard manipulator 23 possibly bringing it to a third or a fourth predetermined operating position. During such movement, the delivery of the moving power and the actuating power is managed by the control system shown in FIGS. 18 and 19 in a manner entirely analogous to the cases described previously which lead to moving the head away by the winches 8 and 9.

In further embodiments of the invention, there may be implemented the swinging or folding of the mast 5 forward when it is brought to the transportation configuration, and not backwards like shown in the figure. In particular bringing the mast 5 subjecting it to a forward swing, moving it from the operating or straight configuration to the transportation or lowered configuration, shall lead to moving the head away—with the return pulleys—from the turret 3 and thus from the winches 8 and 9. Thus, when the winches 8 and 9 are mounted on the self-propelled structure, such winches 8 and 9 and the head shall be moved away from each other, with ensuing greater demand for the rope and the need to unwind it.

As clear to a man skilled in the art, when the mast 5 reaches the straight or operating configuration, even if the additional manipulators 24,25 which control cylinders and winches were used for the adjustment and regulation manoeuvres, the system would operate correctly. Possibly the solution of leaving the known single control manipulators on the cylinder alone, is due to the fact that they are already normally present in the current drilling machines.

In the light of the above, during a movement of the mast 5 between the plurality of operating configurations, in particular between the transportation configuration and the straight configuration, the control means of the control system preferably allow the delivery of the moving power through the movement supply circuit for moving—lifting or lowering—the mast 5, when the actuating power delivered by the actuating supply circuit acts on the winch 8 allowing a rotation of the drum of the winch 8, possibly de-activating the brake thereof, and allowing an unwinding or a winding of the traction element.

Still in the light of the above, in the illustrated embodiment, during the delivery of the moving power through the movement supply circuit for moving (for example, lifting, rotating with a swinging movement towards the straight configuration or inclining in a swinging manner) the mast 5 away with respect to the self-propelled structure 3, the control means of the control system control the actuating power delivered by the supply circuit on the winch 8 allowing a free rotation of the drum of the winch 8, possibly de-activating the motor, for unwinding the traction element. Advantageously such unwinding of the traction element is obtained "passively" due to moving the mast 5 away.

Still in the light of the above, in the illustrated embodiment, during the delivery of the moving power through the movement supply circuit for approaching (for example, lowering, rotating with a swinging movement towards the lifted or swinging configuration in the straight configuration) the mast 5 with respect to the self-propelled structure 3, the control means of the control system control the actuating power delivered by the supply circuit on the winch 8 so as to control a controlled rotation of the drum of the winch 8, possibly by activating the motor, so as to wind the traction element. Advantageously such winding of the traction element occurs "actively" instead, suitably adjusting the rotational speed of the drum by actuating the motor, for example keeping the traction element in a condition or predetermined state of tension. In a possible variant the additional controls for imparting the moving power of the mast 5 and the actuating power of at least one main winch 8 and possibly also the secondary winch 9, may be positioned on a remote control panel (wire or radio-controlled) thus allowing the operator to perform the manoeuvres required for moving the mast 5 in a remote position with respect to the machine so as to certainly check all the steps.

The system for controlling the movement of the mast 5, which includes at least one movement supply circuit and an actuating supply circuit, advantageously comprises a single control 24, 25 which actuates the movement supply circuit and the actuating supply circuit simultaneously and actuates in a coordinated manner: at least one linear actuator 1, 7 and at least one winch 8, 9.

In a variant to the previously described system, the system for controlling the movement of the mast 5, which includes at least one movement supply circuit and an actuating supply circuit, advantageously comprises the monostable switch 19 of the assisted mode which, if kept at the active position by the operator, allows using a single control 20, 23 to simultaneously actuate the movement supply circuit and the actuating supply circuit and actuates in a coordinated manner: at least one linear actuator 1, 7 and at least one winch 8, 9.

A variant to the kinematisms described above is that in which there is a single jack 7 for lifting the mast 5.

A further variant to the kinematism which allows the swinging, is obtained by adding a further jack which performs the actuation to laterally rotate the mast, which is rotatable with respect to an articulation positioned at the lower part of the turret 3. In this case, a lifting jack can be associated with a swinging jack and together and in a coordinated manner, the two actuators may actuate both the lifting of the mast and the relative lateral movement thereof.

Figure 1:
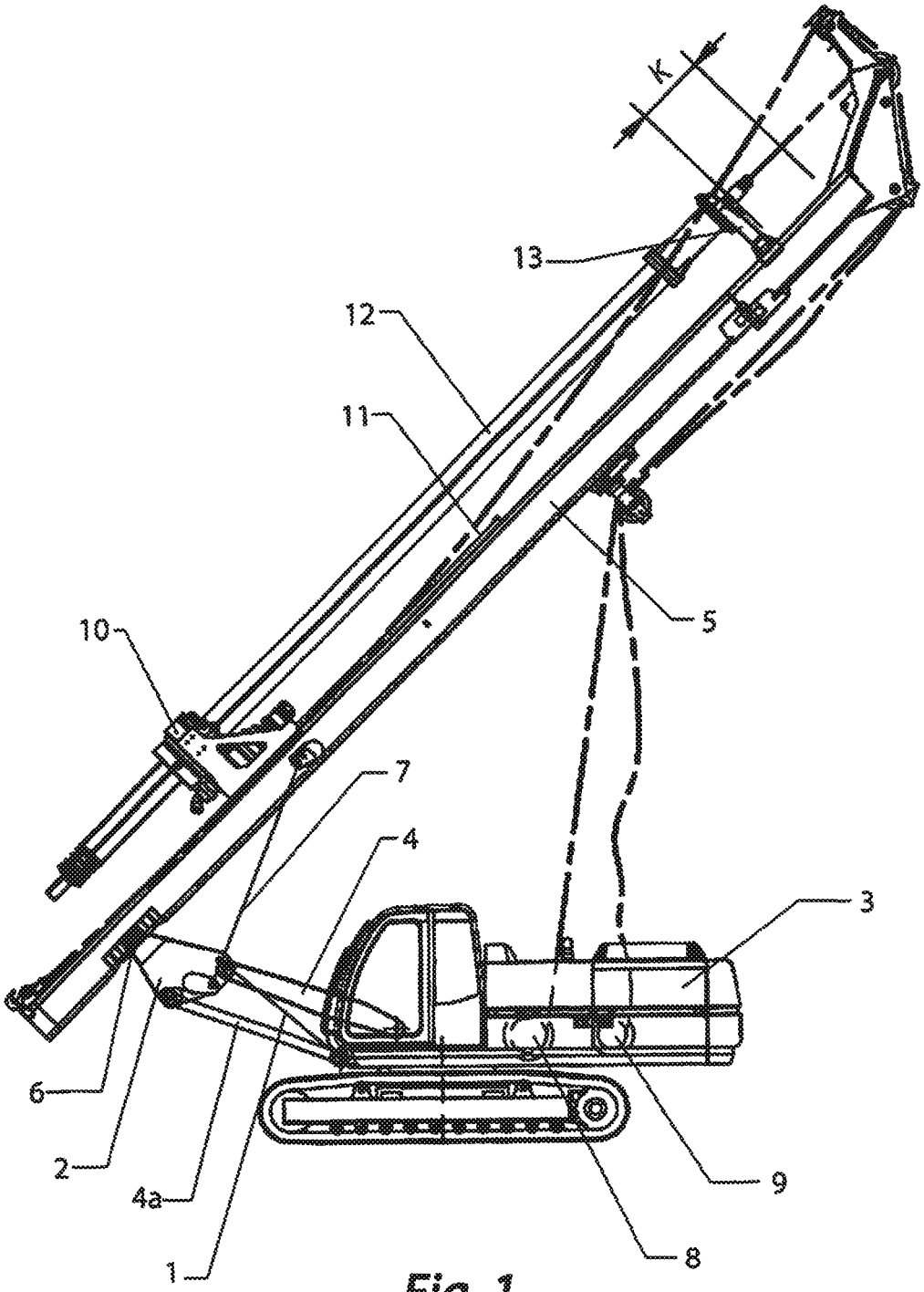
Fig. 1 (PRIOR ART)
FIG. 1 illustrates a side elevation view of a drilling machine for obtaining piles of the per se known type, illustrated in an operating step in the passage between the transportation and the operating configuration.
Figure 3:
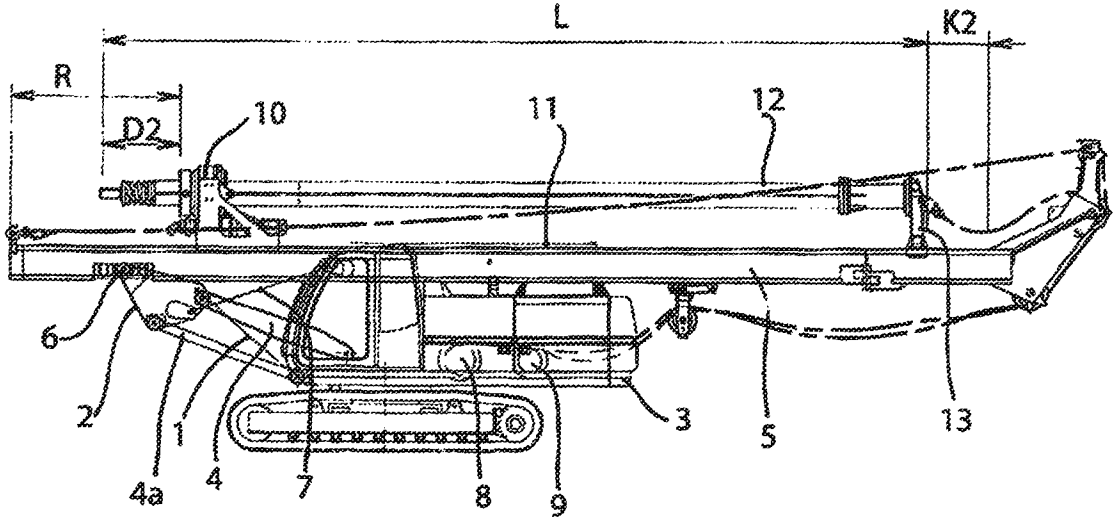
Fig.3 (PRIOR ART)
FIG. 3 illustrates a side elevation view of a drilling machine analogous to that of the preceding figures, but whose mast assumes an intermediate or lifted configuration.
Figure 2:
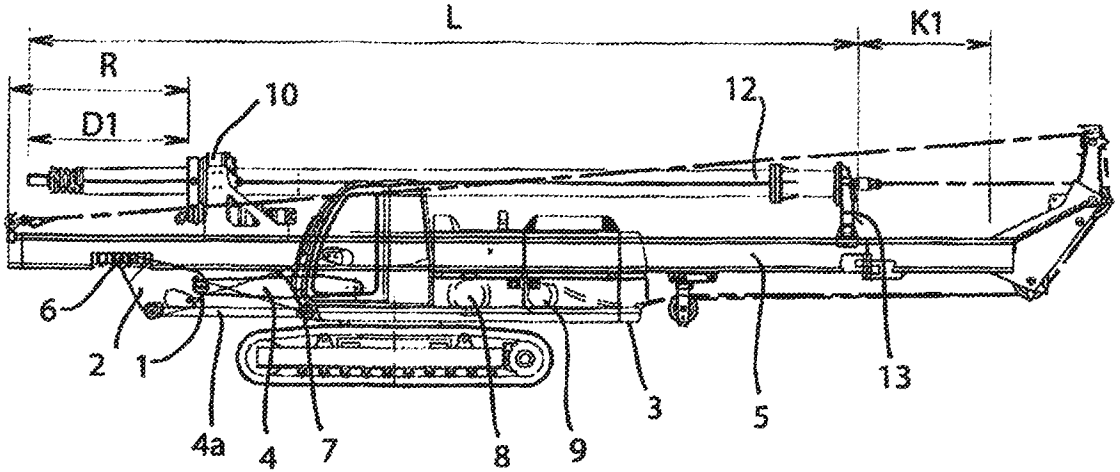
Fig.2 (PRIOR ART)
FIG. 2 illustrates a side elevation view of a drilling machine analogous to that of the FIG. 1, but whose mast assumes a transportation or lowered configuration.
Figure 5:
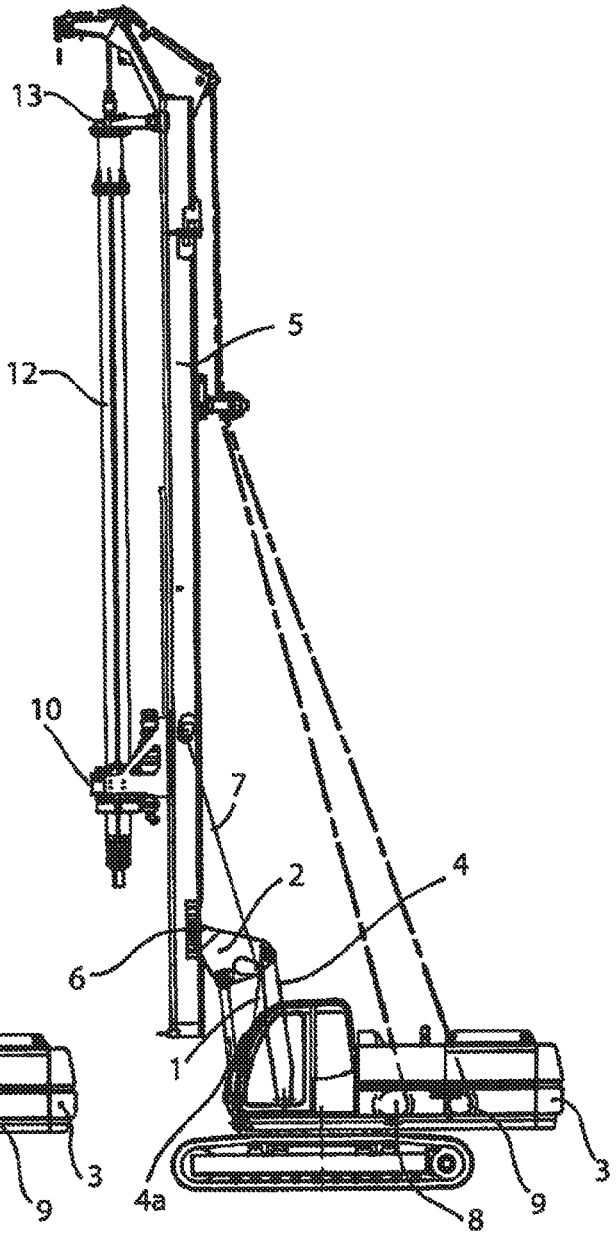
Fig. 5 (PRIOR ART)
FIG. 5 illustrates the machine shown in the preceding figures, wherein it assumes a second operating or maximum radius configuration.
Figure 6:
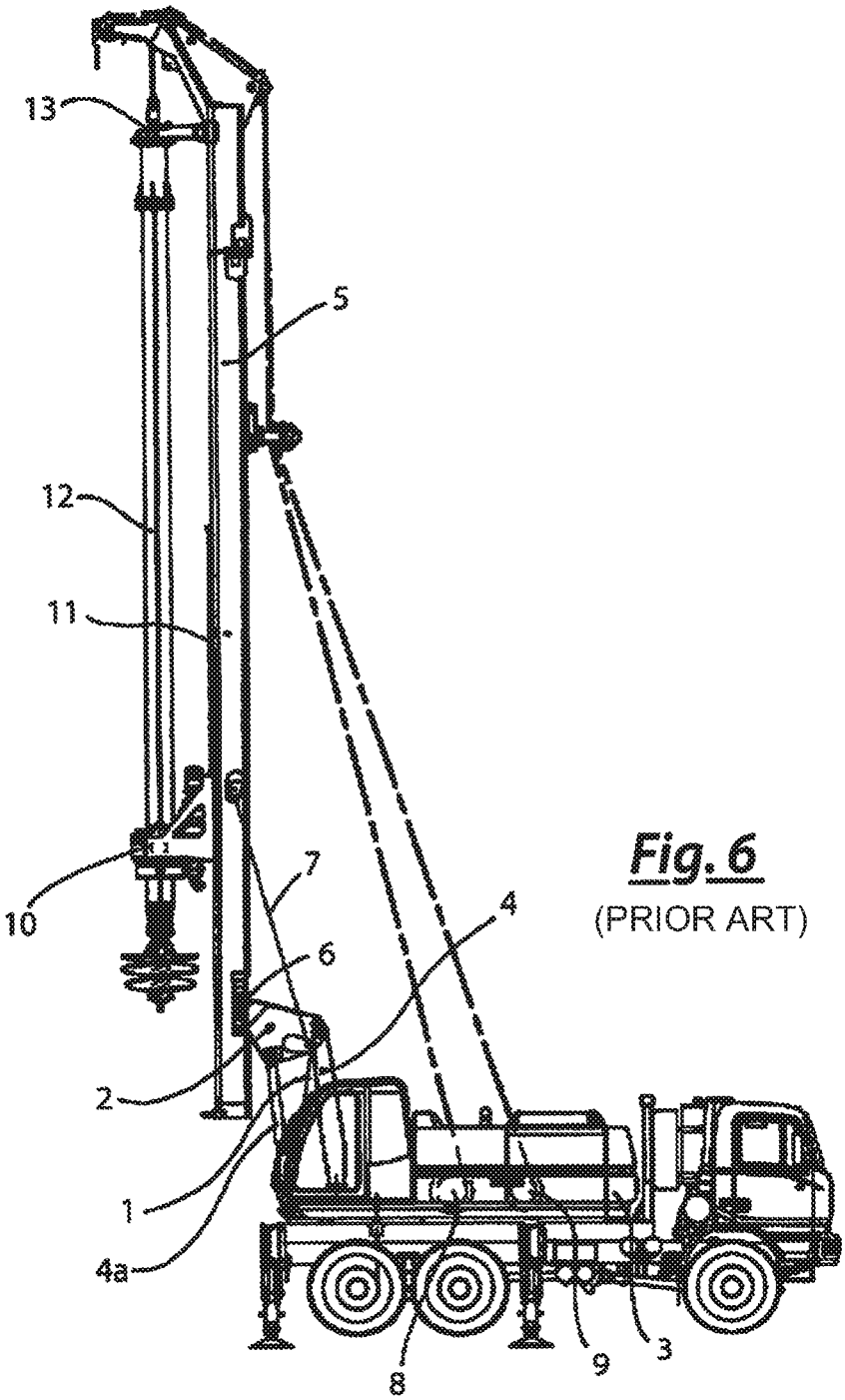
Fig. 6 (PRIOR ART)
FIG. 6 illustrates a truck-type variant of a drilling machine of the known type for obtaining piles.

In order to identify the position of the operating radius (distance between the vertical drilling axis and the fifth wheel axis of the rotation turret 3), there are inserted in suitable instruments for such detection, so as to limit it within the allowed value, hindering the further lowering of the kinematism. Generally, such instrument is an electric limit switch which detects the position of the arm 4 (or any other element of the kinematism) with respect to the framework of the rotary turret 3. Alternatively there may be used rotation encoders, pendulums, etc., also suitable for indirect detention through a calculation which includes the geometry of the kinematism and the mast, so as to determine the value of the operating radius. FIG. 5 shows the kinematism in a completely lifted condition (minimum operating radius) and FIG. 3 shows the kinematism entirely projected forward, lowered with respect to the previous configuration, up to the limit allowed for drilling (maximum operating radius). Completing the passage from the vertical configuration to the horizontal transportation configuration, upon attaining the limit configuration represented by FIG. 3, requires pressing an exclusion button which excludes the maximum operating radius end stroke, and keeping it constantly pressed over the entire duration of the movement from FIG. 3 to FIG. 2 (final transportation configuration) so as to lower the kinematism further. Such manoeuvre further complicates this step due to the fact that the operator in the cabin is required to actuate a further button to allow this movement under safe conditions.

In order to overcome this drawback, the system according to the present invention preferably comprises a device for detecting the angular position of the mast 5 arranged on the kinematism; the device for detecting the angular position is advantageously adapted for enabling the further descent of the kinematism beyond the maximum working radius allowed when the mast 5 is in a substantially horizontal configuration.

The detection device may be a proximity sensor or an electric limit switch or an equivalent system which is however capable of detecting the relative position of the mast with respect to the kinematism. When the antenna is brought to the horizontal configuration starting from the vertical configuration, like the one illustrated in FIG. 3, then the means for detecting the angular position of the antenna with respect to the kinematism, detects that the same is no longer in the vertical operating condition but substantially horizontal. Such device sends an enabling signal to one of the described systems with the aim of excluding the maximum operating radius end stroke means and with priority on the latter, allows the kinematism to be lowered further to lie in the final transportation condition. A more complex version the device for detecting the mast position may be of the absolute type (e.g., a pendulum) which, regardless of the angular configuration assumed by the arm, detects whether the mast reaches the configuration proximal to horizontal. Even in this case, the inserted automatism allows an easier and comfortable as well as safe operation of the machine.

Obviously, without prejudice to the principle of the invention, the implementation embodiments and details may widely vary with respect to what is described and illustrated above purely by way of non-limiting example, without departing from the scope of protection of the invention as defined in the attached claims.

The invention claimed is:

1. A system for controlling the movement of a mast of a drilling machine, wherein the drilling machine includes a self-propelled structure having a framework and a turret, the mast, at least one linear actuator actuatable to move the mast relative to the turret, a drilling assembly that includes a bank of telescopic or kelly bars, a rotary mounted on the mast and configured to transfer power to the drilling assembly, and a winch supported by the turret and configured to wind and unwind a traction element constrained to the drilling assembly, said system comprising:

a movement supply circuit connectable with a power source and for delivering a moving power to at least one linear actuator so as to move the mast so that the mast moves with respect to the turret between a horizontal transport configuration and a vertical operating configuration;

an actuating supply circuit connectable with a power source and for delivering an actuating power to the winch so as to allow the winding or unwinding of the traction element;

a locking device for connecting the bank of telescopic or Kelly bars to the rotary, the locking device comprising a collar coupled to the lower terminal part of the most internal bar of the bank of telescopic or Kelly bars and a retention element, the collar being connected to the rotary by the retention element so that sliding of each bar of the bank of telescopic or Kelly bars along the mast toward a base of the mast is hindered by the locking device during the passage from the transport configuration to the operating configuration; and control means comprising:

a detector for detecting axial sliding of the bank of telescopic or Kelly bars toward a top part of the mast to an end-stroke position, said control means being configured for controlling the delivery of the actuating power as a function of said detection, said control means allowing the delivery of the actuating power to release the traction element from the winch when the detector detects the end-stroke position of the bank of telescopic or Kelly bars during the lifting of the mast; and a switch associated with the movement of the mast, the switch being actuatable to allow the delivery of the moving power to the mast for the lifting or the lowering of the mast, wherein, during the lifting of the mast, the delivery of the moving power and the delivery of the actuating power is controlled in a coordinated manner by the control means so as to keep said traction element of the winch in predetermined state of tension, and during the lowering of the mast, the control means controls the actuating supply circuit to simultaneously impart the actuating power to wind the traction element on the winch, reduce the supply pressure of the motor of the winch to the minimum value sufficient to guarantee the rotation of the winch, and maintain the traction element at a predetermined and settable tension value.

2. The system according to claim 1, wherein said control means allows the delivery of said moving power when the actuating power allows a drum of said winch to rotate so as to wind or unwind said traction element during the movement of said mast between the horizontal transport configuration and the vertical operating configuration.

3. The system according to claim 1, wherein said movement supply circuit is connectable to a source of pressurised fluid; said control means comprising a valve apparatus configured for controlling the passage of said pressurised fluid through said movement supply circuit in a coordinated manner with said actuating power delivered by said actuating supply circuit.

4. The system according to claim 3, wherein the actuating supply circuit is also connectable to the source of pressurized fluid.

5. The system according to claim 1, further comprising an auxiliary actuating supply circuit configured so as to be connected with a power source and for delivering an auxiliary actuating power to an auxiliary winch which is supported by said turret so as to allow the winding or unwinding of a respective auxiliary traction element fixed to said auxiliary winch and removably constrained to said mast; said control means being configured for automatically controlling the moving power delivered in a coordinated manner with the delivery of said auxiliary actuating power.

6. The system according to claim 1, wherein said control means comprise pressure sensors adapted to detect information indicating said actuating power; said control means being configured for controlling the delivery of the moving power as a function of said detected information.

7. The system according to claim 1, wherein said control means further comprise at least one overcenter valve cooperating with said actuating supply circuit.

8. The system according to claim 1, wherein said movement supply circuit and the actuating supply circuit are actuatable by a single switch or manipulator which acts simultaneously and in a coordinated manner on the at least one linear actuator and on the winch.

9. The system according to claim 1, wherein the switch is an assisted mode monostable switch adapted to assume, following the manual actuation of an operator, an active position wherein said movement supply circuit and the actuating supply circuit are actuatable by a single switch or manipulator, which acts simultaneously and in a coordinated manner on the at least one linear actuator and on the winch.

10. The system according to claim 1, wherein said drilling machine comprises a kinematism for adjusting the drilling height connected to said mast, and said system comprises a device for detecting the angular position of the mast arranged on the kinematism, said device for detecting the angular position being adapted for enabling a further descent of the kinematism beyond a maximum working radius when the mast is in the horizontal transport configuration.

11. A method for controlling the movement of a mast of a drilling machine, wherein the drilling machine includes a self-propelled structure having a framework and a turret, the mast, at least one linear actuator actuatable to move the mast relative to the turret, a drilling assembly that includes a bank of telescopic or Kelly bars, a rotary mounted on the mast and configured to transfer power to the drilling assembly, and a winch supported by the turret and configured to wind and unwind a traction element constrained to the drilling assembly, said method comprising the steps of:

delivering a moving power to the at least one linear actuator to produce a movement of the mast relative to the turret among a plurality of operating configurations;

delivering an actuating power to the winch to allow the winding or unwinding of the traction element;

at least temporarily preventing a relative axial movement between said drilling assembly and said mast during the passage between at least two consecutive ones of the plurality of operating configurations using a locking device of the system according to claim 1; and automatically controlling the delivery of said moving power in a coordinated manner with the delivery of said actuating power when said axial movement is hindered using a control means of the system according to claim 1, said control means acting on at least one of a drum and a brake of said winch to keep the traction element at a predetermined state of tension during a movement of the mast between the at least two consecutive ones of the operating configurations.

12. The method according to claim 11, wherein the delivery of said moving power is allowed by the control means when the actuating power delivered to the winch rotates the drum of said winch so as to wind or unwind said traction element during the movement of said mast between said at least two consecutive ones of the operating configurations.

13. The method according to claim 12, wherein said moving power delivered to the at least one linear actuator to produce a movement of said mast contributes to the unwinding of said traction element from the drum of said winch during a movement between said operating configurations that lifts or raises said mast with respect to said turret.

14. The method according to claim 12, wherein said actuating power contributes to impart a rotation of the drum of said winch in a controlled manner so as to wind said traction element on said drum during a movement between said operating configurations that lowers or descends said mast with respect to said turret.

15. The method according to claim 11, wherein, during said movement, said mast remains in a horizontal position and moves between a lowered transportation configuration and a lifted intermediate configuration with respect to the turret, said moving power being delivered to the at least one linear actuator associated to an arm which can be subjected to swinging and is interposed between said mast and said turret.

16. The method according to claim 11, wherein, during said movement, said mast swivels between an inclined configuration and a vertical configuration in response to the moving power.

17. The method according to claim 11, wherein, during said movement, said mast moves with a swinging movement between a horizontal position in a lowered transportation configuration or a lifted intermediate configuration with respect to the turret and a vertical or operating configuration.

18. The method according to claim 11, further comprising the step of delivering an auxiliary actuating power to an auxiliary winch which is supported by said turret so as to allow the winding or unwinding of a respective auxiliary traction element fixed to said auxiliary winch and removably constrained to said mast; said moving power being automatically delivered in a coordinated manner with the delivery of said auxiliary actuating power when the axial movement between said mast and said drilling assembly is hindered at least temporarily and at least in a direction along the longitudinal axis of the mast.

19. The method according to claim 11, further comprising the step of detecting information indicating the actuating power delivered to said winch; said moving power being delivered as a function of said detected information.

* * * * *